US011592768B2

(12) United States Patent
Honda et al.

(10) Patent No.: US 11,592,768 B2
(45) Date of Patent: Feb. 28, 2023

(54) IMAGE FORMING APPARATUS AND IMAGE FORMING METHOD

(71) Applicants: Takahiro Honda, Shizuoka (JP); Yasuo Kamada, Shizuoka (JP); Hiroshi Yamada, Shizuoka (JP)

(72) Inventors: Takahiro Honda, Shizuoka (JP); Yasuo Kamada, Shizuoka (JP); Hiroshi Yamada, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/743,449

(22) Filed: May 13, 2022

(65) Prior Publication Data

US 2022/0404743 A1 Dec. 22, 2022

(30) Foreign Application Priority Data

Jun. 18, 2021 (JP) ..... JP2021-101370

(51) Int. Cl.
*G03G 15/00* (2006.01)
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1605; G03G 15/1615; G03G 15/1625; G03G 15/5008; G03G 15/757
USPC ..... 399/167, 297–299, 302
See application file for complete search history.

(56) References Cited

U.S. PATENT DOCUMENTS 6,936,390 B2 8/2005 Nanya et al.
7,303,847 B2 12/2007 Tomita et al.
7,374,851 B2 5/2008 Nakayama et al.
7,504,188 B2 3/2009 Yamada et al.
8,007,976 B2 8/2011 Sugiura et al.
8,252,500 B2 8/2012 Watanabe et al.
9,785,074 B2 10/2017 Nagata et al.
9,921,503 B2 3/2018 Yamada et al.
10,088,766 B2 10/2018 Santo et al.
(Continued)

FOREIGN PATENT DOCUMENTS

JP 2003-029489 1/2003
JP 2005-115214 4/2005
(Continued)

OTHER PUBLICATIONS

U.S. Appl. No. 17/678,125, filed Feb. 23, 2022.

*Primary Examiner* — William J Royer
(74) *Attorney, Agent, or Firm* — Xsensus LLP

(57) ABSTRACT

An image forming apparatus includes an image bearer, a developing unit configured to develop a latent image formed on the image bearer with a toner to form a toner image, and a transfer member including a contact area that comes in contact with the image bearer. The toner image is primary transferred from the image bearer to the transfer member. A speed difference between the image bearer and the transfer member at the contact area is 0.1% or greater but 0.8% or less. The toner has an average circularity of 0.971 or greater but 0.986 or less and a shape factor SF-2 of 110 or greater but 119 or less. The speed difference is represented by the following formula:

$$\text{Speed difference } [\%] = \{(V1 - V2)/V2\} \times 100 \qquad \text{[Speed difference]}$$

where V1 is a linear speed of the image bearer, and V2 is a linear speed of the transfer member.

6 Claims, 2 Drawing Sheets

(56) References Cited

U.S. PATENT DOCUMENTS

| | | | |
|---|---|---|---|
| 2003/0027074 | A1 | 2/2003 | Emoto et al. |
| 2003/0096185 | A1 | 5/2003 | Yamashita et al. |
| 2003/0134220 | A1 | 7/2003 | Emoto et al. |
| 2003/0138717 | A1 | 7/2003 | Yagi et al. |
| 2003/0152859 | A1 | 8/2003 | Emoto et al. |
| 2004/0131961 | A1 | 7/2004 | Watanabe et al. |
| 2004/0146795 | A1 | 7/2004 | Emoto et al. |
| 2004/0209181 | A1 | 10/2004 | Higuchi et al. |
| 2004/0229147 | A1 | 11/2004 | Higuchi et al. |
| 2005/0112488 | A1 | 5/2005 | Yamada et al. |
| 2006/0024097 | A1 | 2/2006 | Yamada et al. |
| 2007/0184370 | A1 | 8/2007 | Yamashita et al. |
| 2008/0063971 | A1 | 3/2008 | Watanabe et al. |
| 2008/0227000 | A1 | 9/2008 | Honda et al. |
| 2008/0227003 | A1 | 9/2008 | Honda et al. |
| 2008/0280218 | A1 | 11/2008 | Sabu et al. |
| 2008/0280219 | A1 | 11/2008 | Nakayama et al. |
| 2010/0003613 | A1 | 1/2010 | Honda et al. |
| 2010/0021209 | A1 | 1/2010 | Watanabe et al. |
| 2010/0055590 | A1 | 3/2010 | Honda et al. |
| 2010/0285402 | A1 | 11/2010 | Saitoh et al. |
| 2011/0033796 | A1 | 2/2011 | Yamada et al. |
| 2011/0294058 | A1 | 12/2011 | Shiba et al. |
| 2012/0021347 | A1 | 1/2012 | Shimota et al. |
| 2013/0244155 | A1 | 9/2013 | Satoh et al. |
| 2014/0242514 | A1 | 8/2014 | Inoue et al. |
| 2014/0272695 | A1 | 9/2014 | Moritani et al. |
| 2014/0342283 | A1 | 11/2014 | Yamamoto et al. |
| 2015/0104739 | A1 | 4/2015 | Nagatomo et al. |
| 2015/0353677 | A1 | 12/2015 | Izumi et al. |
| 2015/0361213 | A1 | 12/2015 | Kamada et al. |
| 2016/0195828 | A1 | 7/2016 | Satoh et al. |
| 2021/0116830 | A1 | 4/2021 | Takei et al. |
| 2021/0356877 | A1 | 11/2021 | Kamada et al. |
| 2021/0389686 | A1 | 12/2021 | Kakinuma et al. |
| 2022/0050395 | A1 | 2/2022 | Yamada et al. |
| 2022/0057725 | A1 | 2/2022 | Inoue et al. |
| 2022/0137525 | A1 | 5/2022 | Yoshida et al. |

FOREIGN PATENT DOCUMENTS

| | | |
|---|---|---|
| JP | 2007-148078 | 6/2007 |
| JP | 5531377 B2 | 6/2014 |

IMAGE FORMING APPARATUS AND IMAGE FORMING METHOD

CROSS-REFERENCE TO RELATED APPLICATIONS

The present application claims priority under 35 U.S.C. § 119 to Japanese Patent Application No. 2021-101370, filed Jun. 18, 2021. The contents of which are incorporated herein by reference in their entirety.

BACKGROUND OF THE INVENTION

Field of the Invention

The present disclosure relates to an image forming apparatus and an image forming method.

DESCRIPTION OF THE RELATED ART

In the related art, a tandem image forming apparatus has been known as a color image forming apparatus. The tandem image forming apparatus includes several image bearers (e.g., photoconductors) aligned along a transfer conveyance belt, which is an endless moving member, to form a color image. The tandem image forming apparatus is configured to bear a transfer material (e.g., a transfer medium) on the transfer conveyance belt through electrostatic attraction, and to superimpose images of different colors formed on the image bearers onto the transfer material to form a color image.

The tandem image forming apparatus may sometimes cause a transfer failure, so-called a "central image void" phenomenon where a center part of a line, a character, or a slid image is not transferred. In order to reduce the occurrence of the "central image void" phenomenon, a speed difference (also referred to as a linear speed ratio) between the transfer conveyance belt (the transfer member) and each image bearer has been set.

However, the speed difference between the transfer conveyance belt and the image bearer may sometimes cause out of color registration. In the case where the image bearer partially has an area having a high friction coefficient, or the transfer material partially has an area having a high friction coefficient, the friction between the photoconductor and the transfer material is stronger than the friction between the transfer conveyance belt and the transfer material, when such area reaches the transfer position. As a result, the transfer material is transported by the image bearer while slipping on the transfer conveyance belt as long as the area having the friction coefficient is present at the transfer position. Therefore, the transfer material is transported at the linear speed of the image bearer.

Moreover, the transfer conveyance belt may be drooped at the transfer position due to the friction force between the transfer conveyance belt and the image bearer at each transfer position. As a result, the transfer material cannot be stably transported by the transfer conveyance belt.

In order to solve the above-described problems, for example, the following technologies have been proposed.

A patent literature (Japanese Unexamined Patent Application Publication No. 2003-029489) discloses that a speed difference is set between each image bearer and a transfer conveyance belt, and the speed of the image bearer disposed at the downstream side of the transfer conveyance belt traveling direction is set faster than the speed of the image bearer disposed at the upstream side. The literature discloses that, as a result of the speed difference, excellent images can be obtained without causing a central image void phenomenon or out of color registration of a toner.

Another patent literature (Japanese Unexamined Patent Application Publication No. 2007-148078) discloses that linear speeds of image bearers that are positioned at the downstream from an image bearer disposed at the most upstream side relative to the traveling direction of an endless moving member are made different from a linear speed of a transfer medium. As a result, a "central image void" phenomenon can be prevented even when the linear speed of the image bearer disposed at the most upstream side relative to the endless moving member traveling direction and the linear speed of the endless moving member are substantially the same.

SUMMARY OF THE INVENTION

According to an aspect of the present disclosure, an image forming apparatus includes an image bearer, a developing unit configured to develop a latent image formed on the image bearer with a toner to form a toner image, and a transfer member including a contact area that comes in contact with the image bearer, where the toner image is primary transferred from the image bearer to the transfer member. A speed difference between the image bearer and the transfer member at the contact area is 0.1% or greater but 0.8% or less. The toner has an average circularity of 0.971 or greater but 0.986 or less, and a shape factor SF-2 of 110 or greater but 119 or less. The speed difference is represented by the following formula.

$$\text{Speed difference } [\%]=\{(V1-V2)/V2\}\times 100 \qquad \text{[Speed difference]}$$

In the formula above, V1 is a linear speed of the image bearer, and V2 is a linear speed of the transfer member.

DESCRIPTION OF THE EMBODIMENTS

Figure 1:
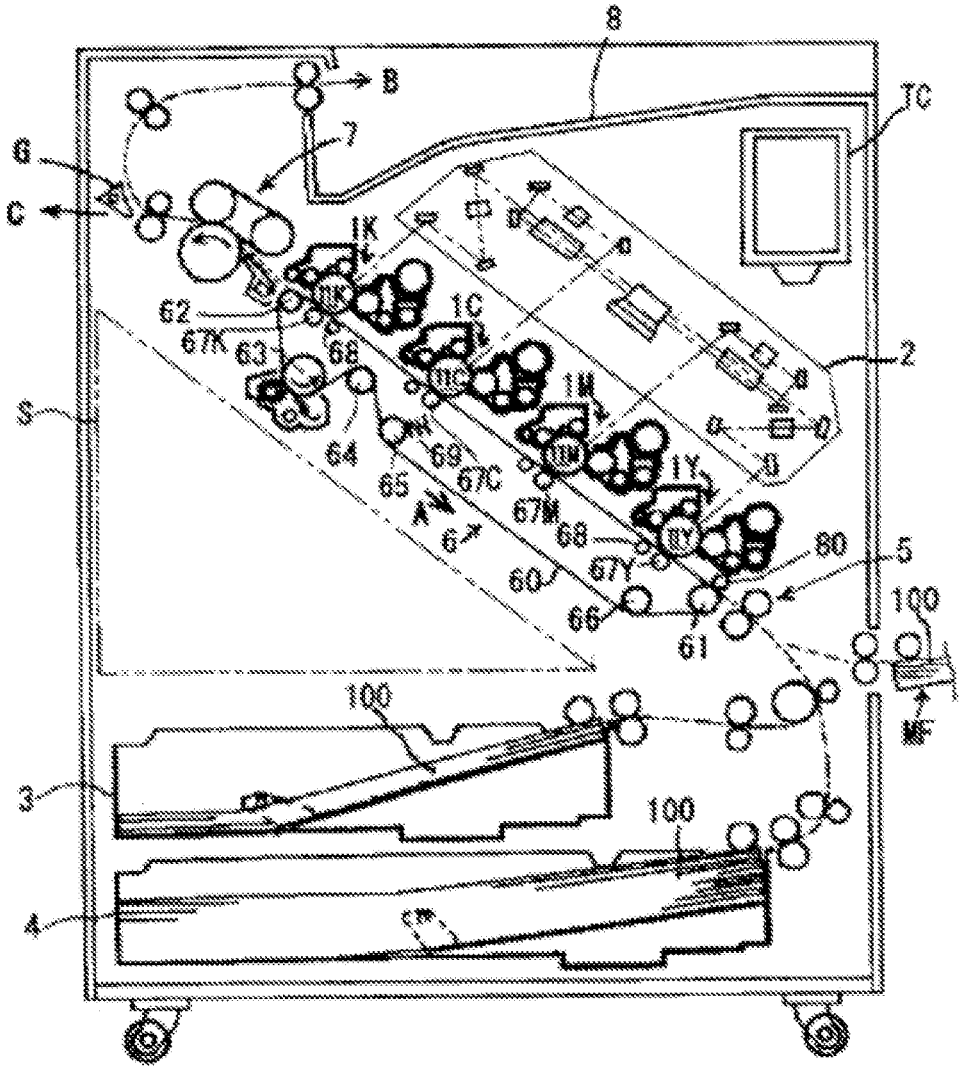
FIG. 1 is a schematic view illustrating an example of an image forming apparatus of the present disclosure.

The image forming apparatus and the image forming method according to the present disclosure will be described with reference to drawings hereinafter. It should be noted that the present disclosure is not limited to the following embodiments, and the following embodiments may be changed by changing to another embodiment, adding, modifying, eliminating, etc. within the range a person in the art can expect. Any of these embodiments are included within the scope of the present disclosure as long as the embodiments exhibit the functions and effects of the present disclosure.

The image forming apparatus of the present disclosure includes an image bearer, a developing unit configured to develop a latent image formed on the image bearer with a toner to form a toner image, and a transfer member including a contact area that comes in contact with the image bearer, where the toner image is primary transferred from the image bearer to the transfer member. A speed difference between the image bearer and the transfer member at the contact area is 0.1% or greater but 0.8% or less. The toner has an average circularity of 0.971 or greater but 0.986 or less, and a shape factor SF-2 of 110 or greater but 119 or less. The speed difference is represented by the following formula.

$$\text{Speed difference [\%]}=\{(V1-V2)/V2\}\times 100 \quad \text{[Speed difference]}$$

In the formula above, V1 is a linear speed of the image bearer, and V2 is a linear speed of the transfer member.

The image forming method of the present disclosure includes developing a latent image formed on an image bearer with a toner to form a toner image, and primary transferring the toner image from the image bearer to a transfer member including a contact area that comes in contact with the image bearer. A speed difference between the image bearer and the transfer member at the contact area is 0.1% or greater but 0.8% or less. The toner has an average circularity of 0.971 or greater but 0.986 or less, and a shape factor SF-2 of 110 or greater but 119 or less. The speed difference is represented by the following formula.

$$\text{Speed difference [\%]}=\{(V1-V2)/V2\}\times 100 \quad \text{[Speed difference]}$$

In the formula above, V1 is a linear speed of the image bearer, and V2 is a linear speed of the transfer member.

In the related art, however, problems associated with image qualities, such as a central image void phenomenon and transfer belt contamination (filming) have not be sufficiently prevented, and there is a problem that an image forming apparatus cannot be stably used over a long period.

Accordingly, the present disclosure has an object to provide an image forming apparatus, which can prevent problems associated with image qualities, such as a central image void phenomenon and filming, and can be stably used over a long period.

The present disclosure can provide an image forming apparatus, which can prevent problems associated with image qualities, such as a central image void phenomenon and filming, and can be stably used over a long period.

An embodiment where an electrophotographic image forming apparatus of the present disclosure is applied for a direct-transfer system tandem laser printer (may be referred to as a "laser printer" hereinafter) will be described hereinafter.

FIG. 1 is a schematic view illustrating a schematic configuration of the laser printer of the present embodiment. The laser printer includes toner image forming units 1Y, 1M, 1C, and 1K, as 4 image forming units configured to form images of yellow (Y), magenta (M), cyan (C), and black (K), respectively. The letters Y, M, C, K accompanied with each numerical reference indicate a member for yellow, a member for magenta, a member for cyan, and a member for black, respectively, hereinafter.

The four toner image forming units 1Y, 1M, 1C, and 1K are sequentially aligned from the upstream side along a traveling direction of transfer paper 100 as a transfer medium (i.e., the direction that the transfer conveyance belt 60 moves along the arrow A in FIG. 1). Each of the toner image forming units 1Y, 1M, 1C, and 1K include a photoconductor drum 11Y, 11M, 11C, or 11K serving as an image bearer, and a developing unit that is an example of a developing unit. Moreover, the arrangement of the toner image forming units 1Y, 1M, 1C, and 1K are set so that the rotational axes of the photoconductor drums are parallel to one another and the toner image forming units are aligned at the predetermined intervals along the transfer sheet traveling direction.

In addition to the toner image forming units 1Y, 1M, 1C, and 1K, the laser printer includes an optical writing unit 2, paper feeding cassettes 3 and 4, a couple of registration rollers 5, a transfer conveyance unit 6 as a transfer conveyance device, a fixing unit 7 employing a belt-fixing system, and a paper ejection tray 8. The transfer conveyance unit 6 includes an endless transfer conveyance belt 60 as a transfer conveyance member configured to bear and transport transfer paper 100 to pass through the transfer position. Moreover, the laser printer includes a manual paper feeding tray M F, and a toner supply container TC, and further includes a waste-toner bottle, a reversing unit for duplex printing, a power source unit, etc. (not illustrated) disposed in the space S marked with a dashdotdotted line.

The optical writing unit 2 includes a light source, a polygon mirror, an f-θ lens, and a reflective mirror, and is configured to scan a surface of the photoconductor drum 11Y, 11M, 11C, or 11K with laser light based on image data to irradiate the photoconductor drum with light.

Figure 2:
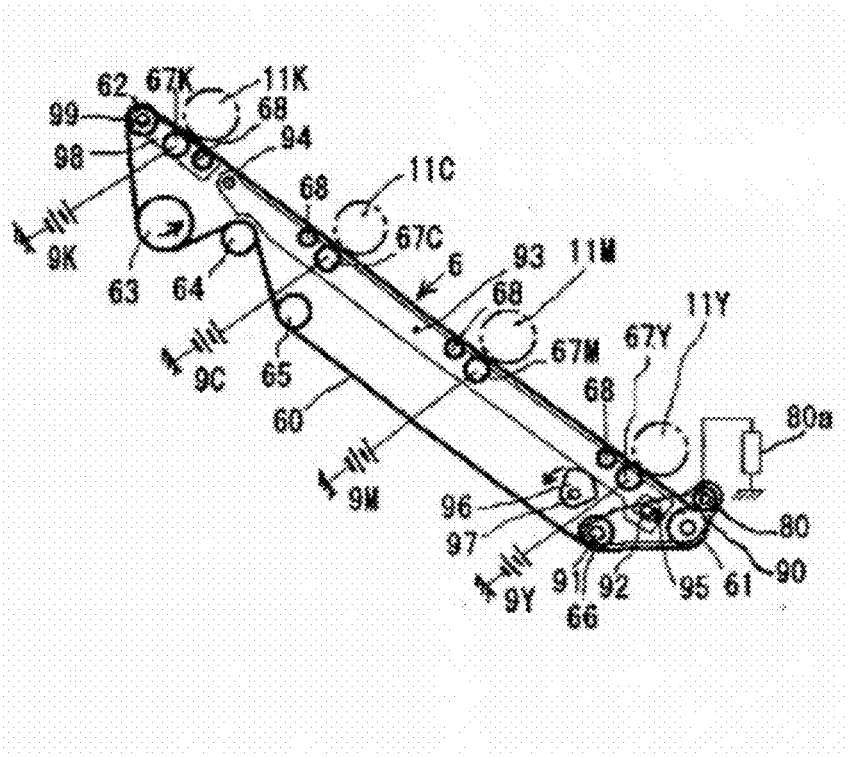
FIG. 2 is a schematic view illustrating a main part of FIG. 1.

FIG. 2 is an enlarged view illustrating a schematic configuration of the transfer conveyance unit 6. The transfer conveyance belt 60 used in the transfer conveyance unit 6 is one example of the transfer member. For example, the transfer conveyance belt 60, which is an endless movable member, is a high resistance single-layer endless belt having volume resistivity of from $10^9$ Ω·cm through $10^{11}$ Ω·cm. A material of the transfer conveyance belt 60 is, for example, polyvinylidene fluoride (PVDF). The transfer conveyance belt 60 is mounted around and supported by supporting rollers 61 to 68 to pass through each transfer position at which the transfer conveyance belt 60 comes in contact with and face the photoconductor drum 11Y, 11M, 11C, or 11K of each toner image forming unit.

Facing the inlet roller 61, which is disposed at the upstream side of the transfer sheet traveling direction among the supporting rollers, an electrostatic attraction roller 80 for transporting a transfer material is disposed at the outer circumferential surface of the transfer conveyance belt 60. To the inlet roller 61, the predetermined voltage is applied from a power source 80*a*. The transfer paper 100 passed through the gap between the above-mentioned two rollers 61 and 80 is held on the transfer conveyance belt 60 with electrostatic attraction. The roller 63 is a driving roller configured to friction-drive the transfer conveyance belt 60. The roller 63 is connected to a driving source (not illustrated), and rotates in the direction indicated with the arrow.

As a transfer electric-field forming unit configured to form a transfer electric field at each transfer position, a transfer bias applying members 67Y, 67M, 67C, and 67K are disposed to be in contact with the back surface of the transfer conveyance belt 60 at the positions facing to the photoconductor drums, respectively. The transfer bias applying members 67Y, 67M, 67C, and 67K are bias rollers each including a sponge disposed at the outer circumference of the roller. Transfer bias is applied to the roller core of the transfer bias applying member from each transfer bias power source 9Y, 9M, 9C, or 9K. Owing to the applied transfer bias, transfer charge is applied to the transfer conveyance belt 60 to form transfer electric field of the predetermined intensity between the transfer conveyance belt 60 and the surface of the photoconductor drum at each transfer position. Moreover, back-up rollers 68 are disposed in order to appropriately maintain the contact between the transfer paper and the photoconductor and secure a desirable transfer nip at the region where transfer is performed.

The transfer bias applying members 67Y, 67M, 67C and the back-up rollers 68 disposed near the transfer bias applying members 67Y, 67M, 67C are integrated and rotatably supported by a swing bracket 93. The swing bracket 93 can be rotated around the rotational axis 94 serving as a center.

The swing bracket 93 is rotated in the clockwise direction as a cam 96 fixed on a cam shaft 97 rotates in the direction indicated with the arrow.

The inlet roller 61 and the electrostatic attraction roller 80 are integrated and supported by an inlet roller bracket 90, which is rotatable in the clockwise direction in FIG. 2 with the shaft 91 as a center of the rotation. A hole 95 formed in the swing bracket 93 is engaged with a pin 92 fixed on the inlet roller bracket 90 to rotate in conjunction with the rotation of the swing bracket 93. As a result of the clockwise rotations of the brackets 90 and 93, the bias applying members 67Y, 67M, and 67C and the back-up rollers 68 disposed near the bias applying members 67Y, 67M, and 67C are separated from the photoconductors 11Y, 11M, and 11C, and the inlet roller 61 and the electrostatic attraction roller 80 also move downwards. It is possible to avoid the contact between the photoconductor drums 11Y, 11M, and 11C and the transfer conveyance belt 60, when only image formation of black is performed.

The separation unit, which is configured to separate the upstream region of the transfer conveyance belt 60 relative to the transfer paper conveyance direction from the photoconductor drums 11Y, 11M, and 11C as described above, includes the swing bracket 93, a cam 96, and an inlet roller bracket 90.

Meanwhile, a transfer bias applying member 67K and a back-up roller disposed next to the transfer bias applying member are rotatably supported by an outlet bracket 98, and the outlet bracket 98 is rotatable around a center that is an axis 99 coaxial to the below-described sensor counter rotating member 62 serving as an outlet roller. When the transfer conveyance unit 6 is detachably mounted in a main body, the transfer conveyance unit 6 is rotated in the clockwise direction by the operation of a handle (not illustrated) to separate the transfer bias applying member 67K and the adjacent back-up roller 68 from the photoconductor 11K for forming a black image.

A cleaning device (not illustrated) including a brush roller and a cleaning blade is disposed to be in contact with the outer circumferential surface of the transfer conveyance belt 60 disposed around the driving roller 63. Foreign matter, such as a toner, deposited on the transfer conveyance belt 60 is removed by the cleaning device. Moreover, a roller 64 is disposed to push the outer circumferential surface of the transfer conveyance belt inwards at downstream from the driving roller 63 relative to the traveling direction of the transfer conveyance belt 60 to thereby secure a contact angle with the driving roller 63. A tension roller 66 configured to apply tension to the belt is disposed inside a loop of the transfer conveyance belt 60 at downstream from the roller 64.

The dash-dotted line in FIG. 1 depicts the traveling path of the transfer paper 100. The transfer paper 100 fed from the paper feeding cassette 3 or 4, or the manual paper feeding tray MF is transported by transporting rollers while guided by a transport guide (not illustrated) and sent to a pause position formed by a pair of registration rollers. The transfer paper 100 fed by the pair of the registration rollers 5 at the predetermined timing is held on the transfer conveyance belt 60, transported towards the toner image forming units 1Y, 1M, 1C, and 1K to pass the transfer nip formed in each transfer position.

In a color mode for forming a full-color image, toner images developed on the photoconductor drums 11Y, 11M, 11C, and 11K of the toner image forming units 1Y, 1M, 1C, and 1K are disposed on the transfer paper 100 at the transfer nips, respectively. Then, the toner images are transferred on the transfer paper 100 by the transfer electric field or nip pressure. As a result of the superimposed transfer, a full-color toner image is formed on the transfer paper 100.

The surface of the photoconductor drum 11Y, 11M, 11C, or 11K, from which the toner image has been transferred, is cleaned by a cleaning device, and the charge is eliminated to be ready for the next formation of an electrostatic latent image.

Meanwhile, the transfer paper 100, on which the full-color toner image has been formed, is subjected to fixing to fix the full-color toner image thereon by the fixing unit 7. Thereafter, the transfer paper 100 is sent to the first paper ejection direction B or the second paper ejection direction C corresponding to the rotation of the switching guide G. When the transfer paper 100 is ejected from the first paper ejection direction B onto the paper ejection tray 8, the transfer paper 100 is stacked in the so-called face-down state, where the image surface faces down. When the transfer paper 100 is ejected from the second paper ejection direction C, the transfer paper 100 is sent to another post-treatment device (e.g., a sorter, and a binding device) (not illustrated), or again sent to the pair of the registration rollers 5 via the switch-back unit for duplex printing.

Next, the characteristics of the present embodiment will be described.

In the present embodiment, the transfer member (e.g., the transfer conveyance belt 60) includes a contact area that comes in contact with the image bearer (e.g., the photoconductor), and a toner image is primary transferred from the image bearer to the transfer member. Moreover, the speed difference between the image bearer and the transfer member at the contact area, which is represented by the following formula, is 0.1% or greater but 0.8% or less. The speed difference is a value indicating how much (%) the linear speed of the photoconductor is greater than the linear speed of the transfer conveyance belt 60.

$$\text{Speed difference } [\%]=\{(V1-V2)/V2\}\times 100 \qquad \text{[Speed difference]}$$

In the formula above, V1 is a linear speed of the image bearer, and V2 is a linear speed of the transfer member.

The speed difference at the contact area is determined from a set value of the linear speed of the photoconductor and a set value of the linear speed of the transfer member.

When the speed difference is less than 0.1%, occurrence of a central image void phenomenon becomes significant. A reason why occurrence of a central image void phenomenon can be prevented by setting the speed difference within the above-mentioned range is considered as follows. When the speed difference is within the above-mentioned range, shearing force acting between the photoconductor and the toner increases to prevent the toner, which is in contact with the photoconductor and the transfer member at the transfer position, from adhering to the photoconductor.

When the speed difference is greater than 0.8%, out of color registration occurs. When the speed difference is set, the transfer material is transported with sliding against the photoconductor at the transfer position. In case where the photoconductor partially has an area having a high friction coefficient or the transfer member partially has an area having a high friction coefficient, the friction force between the photoconductor and the transfer material is greater than the electrostatic attraction force between the transfer conveyance belt and the transfer material, as the area having a high friction coefficient reaches the transfer position. As a result, the transfer material is slipped on the transfer conveyance belt 60 and is transported by the photoconductor, as long as the area having a high friction coefficient is present at the transfer position. Since the transfer material is transported by the photoconductor, the timing of the transfer material for passing through the next transfer position is deviated to cause out of color registration.

The transfer material may be also referred to as a transfer medium, a recording medium, or a medium.

The speed difference is preferably 0.2% or greater but 0.5% or less. When the speed difference is within the above-mentioned range, occurrence of a central image void phenomenon can be prevented, and cleaning performance of a photoconductor or anti-filming properties of an intermediate transfer member can be improved.

When a plurality of the photoconductors are disposed, the photoconductor disposed the most downstream side relative to the traveling direction of the transfer member preferably satisfies the above-described range of the speed difference. More preferably, all of the photoconductors disposed at the downstream side, excluding the photoconductor disposed at the uppermoststream side relative to the traveling direction of the transfer member, satisfy the above-described range of the speed difference.

In the above-described example, the linear speed V1y of the photoconductor 11Y for yellow, which is the photoconductor disposed at the uppermoststream side relative to the transfer paper conveyance direction is set to the substantially same value as the linear speed V2 of the transfer conveyance belt 60, linear speeds V1m, V1c, and V1k of the photoconductors for magenta, cyan, and black, which are disposed downstream from the photoconductor 11Y, are set to be faster than the linear speed V2 of the transfer conveyance belt 60. In the example as mentioned, specifically, all of the photoconductors disposed at the downstream side, excluding the photoconductor disposed at the uppermoststream side, satisfy the above-described condition of the speed difference. As a result, the central image void phenomenon can be prevented.

However, the present embodiment is not limited to the above-mentioned example. For example, the photoconductor 11Y for yellow, which is the photoconductor disposed at the uppermoststream side, may be also set to satisfy the above-described condition of the speed difference.

When the speed of the image bearer at the downstream side relative to the traveling direction of the transfer conveyance belt is set to be faster than the speed of the image bearer disposed at the upstream side, the transfer conveyance belt can be prevented from being drooped between the image bearers. When the linear speeds of the image bearers are set to be slower than the linear speed of the transfer conveyance belt, the force with which the image bearer pulling the transfer conveyance belt towards the upper stream side relative to the traveling direction of the transfer conveyance belt becomes weaker, as the order of the image bearer disposed is closer to the downstream side. As a result, among the image bearers, the image bearer disposed at the upstream side relative to the traveling direction of the transfer conveyance belt pulls the transfer belt with the stronger force than the force with which the image bearer at the downstream side pulling the transfer belt, and therefore the transfer conveyance belt is not drooped between the image bearers. Therefore, a transfer material is stably transported by the transfer conveyance belt, and the transfer material can be passed through the transfer positions at the predetermine timing.

When the linear speeds of the image bearers are set to be faster than the linear speed of the transfer conveyance belt, moreover, the force with which the image bearer pulling the transfer conveyance belt towards the downstream side relative to the traveling direction of the transfer conveyance belt is stronger, as the order of the image bearer disposed is closer to the downstream side. As a result, among the image bearers, the image bearer disposed at the upstream side relative to the traveling direction of the transfer conveyance belt pulls the transfer belt with the stronger force than the force with which the image bearer at the downstream side pulling the transfer belt, and therefore the transfer conveyance belt is not drooped between the image bearers. Therefore, a transfer material is stably transported by the transfer conveyance belt, and the transfer material can be passed through the transfer positions at the predetermine timing.

In the art, moreover, a lubricant etc. may be applied onto an image bearer, such as a photoconductor, for the purpose of protecting a surface layer of the image bearer, or reducing frictions between a member for scraping off a toner, which has not been transferred to a transfer medium, and the image bearer. In the related art, the lubricant etc. may be scrapped off together with the untransferred toner, if a speed difference is set between the image bearer and a transfer conveyance belt. As a result, the removal of the lubricant may adversely affect the above-described object, as well as causing contamination of the transfer belt (filming).

According to the present embodiment, the predetermined toner is used as well as setting the speed difference between the image bearer and the transfer member. Therefore, an image quality problem, such as a central image void phenomenon and filming can be prevented, even when the speed difference is set between the image bearer and transfer member, and the image forming apparatus can be stably used over a long period.

(Toner)

Next, a toner suitably used for the present embodiment will be described in detail.

The toner of the present disclosure has the average circularity of 0.971 or greater but 0.986 or less, and the shape factor SF-2 of 110 or greater but 119 or less.

<Average Circularity and Shape Factor SF-2>

Shapes of particles become far from spheres, i.e. so-called irregular shapes, as a value of the average circularity of the particles reduces. When the average circularity is less than 0.971, transfer performance is impaired due to transfer dust particles etc. generated during electrostatic transfer, and it is difficult to form a high precision image. Therefore, the average circularity being less than 0.971 is not preferable. As a value of the average circularity is closer to 1, shapes of particles are closer to spheres. When the average circularity is greater than 0.986, however, a cleaning failure occurs on a cleaning target, such as a photoconductor and an intermediate transfer belt to cause smear on a resultant image.

The average circularity is preferably 0.974 or greater but 0.984 or less. When the average circularity is in the above-mentioned range, electrostatic attraction force between the photoconductor and the toner is reduced as well as preventing deterioration of a quality, a transfer failure, such as a central image void phenomenon, can be prevented even when the speed difference between the photoconductor and the transfer conveyance belt is small.

The average circularity of the toner can be measured in the following manner. Specifically, a suspension including toner particles of a toner sample is passed through the image capturing unit detection region above a flat plate, to optically capture particles images of the toner by a CCD camera. From each particle image, a value obtained by dividing a perimeter of a corresponding circle having the same area as the area of the projected image by a perimeter of the actual particle was determined. An average value of the determined values is calculated. The calculated average value is determined as the average circularity. In order to measure the average circularity, for example, a flow particle image analyzer FPIA-2100 (available from Sysmex Corporation) may be used. When the above-mentioned particle image analyzer is used, from 0.1 mL through 0.5 mL of a surfactant, preferably alkylbenzene sulfonic acid salt, as a dispersant is added to from 100 mL through 150 mL of water in a vessel, from which solid impurities have been removed. Then, from about 0.1 g through about 0.5 g of a toner sample is added. The resultant suspension is dispersed for about 1 minute through about 3 minutes by an ultrasonic wave disperser to adjust the concentration of the dispersion liquid to from 3,000 particles/μL through 100,000 particles/μL. The resultant is provided to the above-described device to measure shapes and distribution of the toner particles.

The shape factor SF-2 is an index representing surface irregularities (convex-concave shapes). The toner particle is a true sphere having a smooth surface without surface irregularities, as the shape factor SF-2 thereof is close to 100. Similarly to the above-described average circularity, there is an appropriate range of the shape factor SF-2 in order to secure stable image formation over a long period. When the shape factor SF-2 is less than 110, as described above, a particle is close to a sphere without surface irregularities and therefore a cleaning failure occurs on a cleaning target, such as a photoconductor and an intermediate transfer belt to cause smear on a resultant image.

Conversely, excessive irregularities formed on the top surface of the toner base particle is not preferable because transfer properties are impaired. Therefore, the shape factor SF-2 of the toner is 119 or less. The reason why the transfer properties are impaired is not clear, but it is considered that external additives, such as metal inorganic particles, present on the outermost surface of the toner particle are present in deep recesses (concave parts) to reduce the existence probability of the external additives on the convex parts, and therefore adhesion force between the photoconductor and the toner increases.

The shape factor SF-2 is preferably 112 or greater but 117 or less. When the shape factor SF-2 is preferably 112 or greater but 117 or less, cleaning performance can be improved to prevent smearing on an image, and transfer properties can be improved.

SF-2 of the toner can be determined by determining a perimeter and projected area of the toner from the two-dimensional projected image of the toner, and calculating according to the following formula.

$$SF\text{-}2=(\text{perimeter})^2/(\text{projected area})\times(1/4\pi)\times100$$

In the present embodiment, the shape factor SF-2 of the toner is determined by obtaining an enlarged view of a toner image by means of a scanning electron microscope SU8230 (available from Hitachi High-Tech Corporation), and calculating using an image analyzer (Luzex III) available from NIRECO. SF-2 is calculated with 100 toner particles, and the average value of the calculated values is determined as the shape factor SF-2.

<Organic Particles>

The toner of the present embodiment includes toner base particles, and organic particles embedded in a surface of each of the toner base particles. A standard deviation is preferably 500 nm or less. The standard deviation is a standard deviation of a distance between the organic particles disposed next to one each other without being in contact. Moreover, the standard deviation is a standard deviation of a straight line distance connecting between a center of one organic particle and a center of another organic particle.

Since the organic particles are disposed on the surface of the toner base particles with gaps between the organic particles, heat resistant storage stability of a resultant toner can be secured without inhibiting heat conduction to the toner during fixing. Since the organic particles are homogeneously disposed to have a gap between the organic particles next to one another, moreover, adhesion strength of inorganic particles, such as silica and titanium, externally added to surfaces of the toner base particles can be achieved, as well as improving the above-described effect. As a result, a certain amount of the inorganic particles are detached from the toner base particles, and the detached inorganic particles are accumulated on a contact surface between the cleaning blade and the photoconductor to realize excellent cleaning performance. Moreover, the appropriate amount of the detached inorganic particles is maintained, and therefore filming can be prevented.

The organic particles are preferably particles of at least one styrene-acrylic resin including carboxylic acid, which is obtained through homopolymerization or copolymerization of a vinyl monomer. Moreover, the organic particles are preferably particles composed of 2 styrene-acrylic resins a1 and a2, and are more preferably particles each having a core-shell structure including a shell composed of a styrene-acrylic resin a 1 and a core composed of a styrene-acrylic resin a2. Within the organic particles including a vinyl unit derived from the resin (a1) and a vinyl unit derived from the resin (a2), the resin (a2) is a polymer obtained through homopolymerization or copolymerization of a vinyl monomer.

Examples of the vinyl monomer include the following (1) to (10).

(1) Vinyl Hydrocarbon

Examples of the vinyl hydrocarbon include (1-1) aliphatic vinyl hydrocarbon, (1-2) alicyclic vinyl hydrocarbon, and (1-3) aromatic vinyl hydrocarbon.

(1-1) Aliphatic Vinyl Hydrocarbon

Examples of the aliphatic vinyl hydrocarbon include alkene and alkadiene.

Specific examples of the alkene include ethylene, propylene, and α-olefin.

Specific examples of the alkadiene include butadiene, isoprene, 1,4-pentadiene, 1,6-hexadiene, and 1,7-octadiene.

(1-2) Alicyclic Vinyl Hydrocarbon

Examples of the alicyclic vinyl hydrocarbon include mono- or di-cycloalkene and alkadiene. Specific examples thereof include (di)cyclopentadiene, and terpene.

(1-3) Aromatic Vinyl Hydrocarbon

Examples of the aromatic vinyl hydrocarbon include styrene, and hydrocarbyl (alkyl, cycloalkyl, aralkyl and/or alkenyl)-substituted styrene. Specific examples thereof include α-methylstyrene, 2,4-dimethylstyrene, and vinyl naphthalene.

(2) Carboxyl Group-Containing Vinyl Monomer and Salts Thereof

Examples of the carboxyl group-containing vinyl monomer and salts thereof include C3-C30 unsaturated monocarboxylic acid (salt), unsaturated dicarboxylic acid (salt), anhydrides (salt) thereof, and monoalkyl (C1-C24) ester thereof and salt thereof.

Specific examples thereof include: carboxyl group-containing vinyl monomers, such as (meth)acrylic acid, maleic acid (anhydride), monoalkyl maleate, fumaric acid, monoalkyl fumarate, crotonic acid, itaconic acid, monoalkyl itaconate, itaconic acid glycol monoether, citraconic acid, monoalkyl citraconate, and cinnamic acid; and metal salts thereof.

In the present specification, the term "acid (salt)" means acid or a salt of the acid. For example, C3-C30 unsaturated monocarboxylic acid (salt) means unsaturated monocarboxylic acid or a salt thereof.

In the present specification, the term "(meth)acryl" means methacrylic acid or acrylic acid. In the present specification, the term "(meth)acryloyl" means methacryloyl or acryloyl. In the present specification, the term "(meth)acrylate" means methacrylate or acrylate.

(3) Sulfonic Acid Group-Containing Vinyl Monomer, Vinyl Sulfuric Acid Monoester Compound, and Salts Thereof Examples of the sulfonic acid group-containing vinyl monomer, vinyl sulfuric acid monoester compound and salts thereof include C2-C14 alkene sulfonic acid (salt), C2-C24 alkyl sulfonic acid (salt), sulfo(hydroxy)alkyl-(meth)acrylate (salt), sulfo(hydroxy)alkyl-(meth)acrylamide (salt), and alkylallylsulfosuccinic acid (salt).

Specific examples of the C2-C14 alkene sulfonic acid include vinyl sulfonic acid (salt). Specific examples of the C2-C24 alkyl sulfonic acid (salt) include α-methylstyrenesulfonic acid (salt). Specific examples of the sulfo(hydroxy) alkyl-(meth)acrylate (salt) and sulfo(hydroxy)alkyl-(meth) acrylamide (salt) include sulfopropyl(meth)acrylate (salt), sulfuric acid ester (salt), and a sulfonic acid group-containing vinyl monomer (salt).

(4) Phosphoric Acid Group-Containing Vinyl Monomer and Salts Thereof

Examples of the phosphoric acid group-containing vinyl monomer and salts thereof include (meth)acryloyloxyalkyl (the number of carbon atoms: from 1 through 24) phosphoric acid monoester (salt), and (meth)acryloyloxyalkyl (the number of carbon atoms: from 1 through 24) phosphonic acid (salt).

Specific examples of the (meth)acryloyloxyalkyl (the number of carbon atoms: from 1 through 24) phosphoric acid monoester (salt) include 2-hydroxyethyl(meth)acryloyl phosphate (salt), and phenyl-2-acryloyloxyethyl phosphate (salt).

Specific examples of the (meth)acryloyloxyalkyl (the number of carbon atoms: from 1 through 24)phosphonic acid (salt) include 2-acryloyloxyethylphosphonic acid (salt).

Examples of salts of (2) to (4) above include alkali metal salts (e.g., sodium salt, and potassium salt), alkaline earth metal salts (e.g., calcium salt, and magnesium salt), ammonium salts, amine salts, and quaternary ammonium salts.

(5) Hydroxyl Group-Containing Vinyl Monomer

Examples of the hydroxyl group-containing vinyl monomer include hydroxystyrene, N-methylol(meth)acrylamide, hydroxyethyl(meth)acrylate, hydroxypropyl(meth)acrylate, polyethylene glycol mono(meth)acrylate, (meth)allyl alcohol, crotyl alcohol, isocrotyl alcohol, 1-buten-3-ol, 2-buten-1-ol, 2-butane-1,4-diol, propargylalcohol, 2-hydroxyethylpropenyl ether, and sucrose allyl ether.

(6) Nitrogen-Containing Vinyl Monomer

Examples of the nitrogen-containing vinyl monomer include (6-1) an amino group-containing vinyl monomer, (6-2) an amide group-containing vinyl monomer, (6-3) a nitrile group-containing vinyl monomer, (6-4) a quaternary ammonium cation group-containing vinyl monomer, and (6-5) a nitro group-containing vinyl monomer.

Examples of the (6-1) amino group-containing vinyl monomer include aminoethyl (meth)acrylate.

Examples of the (6-2) amide group-containing vinyl monomer include (meth)acrylamide, and N-methyl(meth) acrylamide.

Examples of the (6-3) nitrile group-containing vinyl monomer include (meth)acrylonitrile, cyanostyrene, and cyanoacrylate.

Examples of the (6-4) quaternary ammonium cation group-containing vinyl monomer include quaternized compound (quaternized using a quaternizing agent, such as methyl chloride, dimethyl sulfate, benzyl chloride, and dimethyl carbonate) of a tertiary amine group-containing vinyl monomer (e.g., dimethylaminoethyl(meth)acrylate, diethylaminoethyl(meth)acrylate, dimethylaminoethyl (meth)acrylamide, diethylaminoethyl(meth)acrylamide, and diallylamine).

Examples of the (6-5) nitro group-containing vinyl monomer include nitrostyrene.

(7) Epoxy Group-Containing Vinyl Monomer

Examples of the epoxy group-containing vinyl monomer include glycidyl (meth)acrylate, tetrahydrofurfuryl (meth) acrylate, and p-vinyl phenyl phenyl oxide.

(8) Halogen Element-Containing Vinyl Monomer

Examples of the halogen element-containing vinyl monomer include vinyl chloride, vinyl bromide, vinylidene chloride, allyl chloride, chlorostyrene, bromoetyrene, dichlorostyrene, chloromethylstyrene, tetrafluorostyrene, and chloroprene.

(9) Vinyl Ester, Vinyl (Thio)Ether, Vinyl Ketone

Examples of the (9-1) vinyl ester include vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzylmethacrylate, phenyl(meth)acrylate, vinyl methoxy acetate, vinyl benzoate, ethyl α-ethoxyacrylate, C1-C50 alkyl group-containing alkyl(meth)acrylate [e.g., methyl (meth)acrylate, ethyl (meth)acrylate, propyl (meth)acrylate, butyl (meth)acrylate, 2-ethylhexyl (meth)acrylate, dodecyl (meth)acrylate, hexadecyl (meth)acrylate, heptadecyl (meth)acrylate, octadecyl (meth)acrylate, eicosyl (meth) acrylate, and behenyl (meth)acrylate)], dialkyl fumarate (where 2 alkyl groups are each a C2-C8 straight-chain or branched-chain alicyclic group), dialkyl maleate (where 2 alkyl groups are each a C2-C8 straight-chain or branched-chain alicyclic group), poly(meth)allyloxy alkane [e.g., diallyloxy ethane, triallyloxy ethane, tetraallyloxy ethane, tetraallyloxy propane, tetraallyloxy butane, and tetramethaallyloxy ethane], a polyalkylene glycol chain-containing vinyl monomer [e.g., polyethylene glycol (molecular weight: 300) mono(meth)acrylate, polypropylene glycol (molecular weight: 500) monoacrylate, (meth)acrylate of a methyl alcohol ethylene oxide (10 mol) adduct, and (meth) acrylate of a lauryl alcohol ethylene oxide (30 mol) adduct], and poly(meth)acrylate [e.g., poly(meth)acrylate of polyvalent alcohol:ethylene glycol di(meth)acrylate, propylene glycol di(meth)acrylate, neopentyl glycol di(meth)acrylate, trimethylolpropane tri(meth)acrylate, and polyethylene glycol di(meth)acrylate].

Examples of the (9-2) vinyl (thio)ether include vinyl methyl ether.

Examples of the (9-3) vinyl ketone include methyl vinyl ketone.

(10) Other Vinyl Monomers

Examples of other vinyl monomers include tetrafluoroethylene, fluoroacrylate, isocyanatoethyl (meth)acrylate, and m-isopropenyl-α,α-dimethylbenzyl isocyanate.

The above-listed vinyl monomers (1) to (10) may be used alone or in combination for synthesis of the organic particles.

Considering low temperature fixability of composite resin particles of the present disclosure, the organic particles are preferably particles composed of a styrene-(meth)acrylic acid ester copolymer or a (meth)acrylic acid ester copolymer, and more preferably particles composed of a styrene-(meth)acrylic acid ester copolymer.

Within the organic particles including the vinyl unit derived from the resin (a1) and the vinyl unit derived from the resin (a2), the resin (a2) is a polymer obtained through homopolymerization or copolymerization of a vinyl monomer.

Examples of the vinyl monomer include vinyl monomers identical to the vinyl monomers listed for the resin (a1). The vinyl monomers (1) to (10) listed for the resin (a1) may be used alone or in combination for synthesis of the resin (a2).

The resin (a2) is preferably a styrene-(meth)acrylic acid ester copolymer and a (meth)acrylic acid ester copolymer, and more preferably a styrene-(meth)acrylic acid ester copolymer, considering low temperature fixability of the resin particles for use in the present disclosure.

The viscoelastic loss modulus G" of the resin (a1) at 100° C. with the frequency of 1 Hz is preferably from 1.5 MPa through 100 MPa, more preferably from 1.7 MPa through 30 MPa, and even more preferably from 2.0 MPa through 10 MPa.

The viscoelastic loss modulus G" of the resin (a2) at 100° C. with the frequency of 1 Hz is preferably from 0.01 MPa through 1.0 MPa, more preferably from 0.02 MPa through 0.5 MPa, and even more preferably from 0.05 MPa through 0.3 MPa. When the viscoelastic loss modulus G" is within the above-mentioned range, toner particles, on each surface of which resin particles each including the resin (a1) and the resin (a2) as constitutional components per particle are deposited, are easily formed.

The viscoelastic loss modulus G" of the resins (a1) and (a2) at 100° C. with frequency of 1 Hz can be adjusted by varying monomers for use and a blending ratio thereof, and adjusting polymerization conditions (e.g., an initiator for use and an amount thereof, a chain-transfer agent for use and an amount thereof, and a reaction temperature). Specifically, for example, G" of each resin can be adjusted to the above-mentioned range by adjusting the composition of the resin as follows.

(1) Tg1 is preferably from 0° C. through 150° C., more preferably from 50° C. through 100° C., where Tg1 is a glass transition temperature calculated from the monomers constituting the resin (a1). Tg2 is preferably from −30° C. through 100° C., more preferably from 0° C. through 80° C., and even more preferably from 30° C. through 60° C., where Tg2 is a glass transition temperature calculated from the monomers constituting the resin (a2).

The glass transition temperature (Tg) calculated from the constitutional monomers is a value calculated according to the Fox method.

The Fox method IT. G. Fox, Phys. Rev., 86, 652(1952)] is a method for estimating Tg of a copolymer from Tg of each homopolymer as represented by the following formula.

$$1/Tg=W1/Tg1+W2/Tg2+\ldots+Wn/Tgn$$

[In the formula above, Tg is a glass transition temperature (absolute temperature) of a copolymer, Tg1, Tg2 . . . Tgn are each a glass transition temperature (absolute temperature) of a homopolymer of each monomer component, and W1, W2 . . . Wn are each a weight fraction of each monomer component.]

(2) (AV1) is preferably from 75 mgKOH/g through 400 mgKOH/g, and more preferably from 150 mgKOH/g through 300 mgKOH/g, where (AV1) is a calculated acid value of the resin (a1). Moreover, (AV2) is preferably from 0 mgKOH/g through 50 mgKOH/g, more preferably from 0 mgKOH/g through 20 mgKOH/g, and even more preferably 0 mgKOH/g, where (AV2) is a calculated acid value of the resin (a2).

The calculated acid value is a theoretical acid value calculated from a molar quantity of acid groups included in the constitutional monomers, and a total weight of the constitutional monomers.

As a constitutional monomer satisfying the conditions of (1) and (2), for example, the resin (a1) is a resin including, as constitutional monomers, styrene preferably in an amount of from 10% by weight through 80% by weight, and more preferably from 30% by weight through 60% by weight, and methacrylic acid and/or acrylic acid preferably in the combined amount of from 10% by weight through 60% by weight, and more preferably from 30% by weight through 50% by weight, relative to a total mass of the resin (a1).

Moreover, the resin (a2) is, for example, a resin including, as constitutional monomers, styrene preferably in an amount of from 10% by weight through 100% by weight, and more preferably from 30% by weight through 90% by weight, and methacrylic acid and/or acrylic acid preferably in the combined amount of from 0% by weight through 7.5% by weight, and more preferably from 0% by weight through 2.5% by weight, relative to a total mass of the resin (a2).

(3) Polymerization conditions (e.g., an initiator for use and an amount thereof, a chain-transfer agent for use and an amount thereof, and a reaction temperature) are adjusted. Specifically, as the number average molecular weight (Mn1) of the resin (a1) and the number average molecular weight (Mn2) of the resin (b2), (Mn1) is set to preferably from 2,000 through 2,000,000, and more preferably from 20,000 through 200,000, and (Mn2) is set to preferably from 1,000 through 1,000,000, and more preferably from 10,000 through 100,000.

In the present disclosure, viscoelastic loss modulus G" is measured, for example, by means of the following rheometer.

Device: ARES-24A (available from Rheometric Scientific)
Jig: 25 mm parallel plate
Frequency: 1 Hz
Distortion factor: 10%
Heating rate: 5° C./min The acid value (AVa1) of the resin (at) is preferably from 75 mgKOH/g through 400 mgKOH/g, and more preferably from 150 mgKOH/g through 300 mgKOH/g. When the acid value (AVa1) of the resin (a1) is within the above-mentioned range, toner particles on each surface of which resin particles including vinyl units including the resin (a1) and the (a2) as constitutional components per particle are deposited are easily formed. The resin (a1) having the acid value in the above-mentioned range is a resin including methacrylic acid and/or acrylic acid preferably in the combined amount of from 10% by weight through 60% by weight, and more preferably from 30% by weight through 50% by weight, relative to a total weight of the resin (a 1).

The acid value (AVa2) is preferably from 0 mgKOH/g through 50 mgKOH/g, more preferably from 0 mgKOH/g through 20 mgKOH/g, and even more preferably 0 mgKOH/g, considering low temperature fixability.

The resin (a2) having the acid value in the above-mentioned range is a resin including methacrylic acid and/or acrylic acid preferably in the combined amount of from 0% by weight through 7.5% by weight, and more preferably from 0% by weight through 2.5% by weight, relative to a total weight of the resin (a2).

In the present disclosure, the acid value is measured by a method according to JIS K0070:1992.

The glass transition temperature of the resin (a1) is preferably higher than the glass transition temperature of the resin (a2). When the glass transition temperature of the resin (a1) is within the above-mentioned range, excellent balance between easiness of formation of toner particles on each surface of which the resin particles are deposited, and low temperature fixability of the toner particles of the present disclosure can be achieved.

The glass transition temperature of the resin (a1) is more preferably higher than the glass transition temperature of the resin (a2) by 10° C. or greater, and even more preferably higher by 20° C. or greater.

The glass transition temperature (may be abbreviated as Tg hereinafter) of the resin (a1) is preferably from 0° C. through 150° C., and more preferably from 50° C. through 100° C. When the glass transition temperature thereof is 0° C. or higher, favorable preservability of the resin particles of the present disclosure can be obtained. When the glass transition temperature thereof is 150° C. or lower, the resin (a1) does not adversely affect low temperature fixability.

Tg of the resin (a2) is preferably from −30° C. through 100° C., more preferably 0° C. through 80° C., and even more preferably from 30° C. through 60C. When the glass transition temperature thereof is −30° C. or higher, favorable preservability of the resin particles can be obtained. When the glass transition temperature thereof is 100° C. or lower, the resin (a2) does not adversely affect low temperature fixability.

In the present disclosure, Tg is measured by means of DSC20, SSC/580 (available from Seiko Instruments Inc.) by a method (DSC) specified in ASTM D3418-82.

The solubility parameter (may be abbreviated as an SP value hereinafter) of the resin (a1) is preferably from 9 $(cal/cm^3)^{1/2}$ through 13 $(cal/cm^3)^{1/2}$, more preferably from 9.5 $(cal/cm^3)^{1/2}$ through 12.5 $(cal/cm^3)^{1/2}$, is and even more preferably from 10.5 $(cal/cm^3)^{1/2}$ through 11.5 $(cal/cm^3)^{1/2}$, considering easiness of formation of toner particles on each surface of which the resin particles each including the resin (a1) and the resin (a2) as the constitutional components per particle are deposited. The SP value of the resin (a1) can be adjusted by changing monomers used to constitute the resin (a1) and a composition ratio thereof.

The SP value of the resin (a2) is preferably from 8.5 $(cal/cm^3)^{1/2}$ through 12.5 $(cal/cm^3)^{1/2}$, more preferably from 9 $(cal/cm^3)^{1/2}$ through 12 $(cal/cm^3)^{1/2}$, and even more preferably from 10 $(cal/cm^3)^{1/2}$ through 11 $(cal/cm^3)^{1/2}$, considering easiness of formation of toner particles on each surface of which the resin particles each including the resin (a1) and the resin (a2) as the constitutional components per particle are deposited. The SP value of the resin (a2) can be adjusted by changing monomers used to constitute the resin (a2) and a composition ratio thereof.

In the present disclosure, the SP value can be calculated by the method of Fedors [Polym. Eng. Sci. 14(2)152, (1974)].

Considering Tg of the resin (a1) and copolymerizability with other monomers, the resin (a1) includes, as a constitutional monomer, styrene preferably in an amount of from 10% by weight through 80% by weight, and more preferably from 30% by weight through 60% by weight, relative to total mass of the resin (a1).

Considering Tg of the resin (a2) and copolymerizability with other is monomers, the resin (a2) includes, as a constitutional monomer, styrene preferably in an amount of from 10% by weight through 100% by weight, and more preferably from 30% by weight through 90% by weight, relative to total weight of the resin (a2).

The number average molecular weight (Mn) of the resin (a1) is preferably from 2,000 through 2.000,000, and more preferably from 20,000 through 200,000. When the number average molecular weight thereof is 2,000 or greater, favorable preservability of the resin particles of the present disclosure is obtained. When the number average molecular weight thereof is 2,000,000 or less, the resin (a1) does not adversely affect low temperature fixability of the resin particles of the present disclosure.

The weight average molecular weight of the resin (a1) is preferably greater than the weight average molecular weight of the resin (a2), more preferably greater than the weight average molecular weight of the resin (a2) by 1.5 times or greater, and even more preferably greater than the weight average molecular weight of the resin (a2) by 2.0 times or greater. When the weight average molecular weight of the resin (a1) is within the above-mentioned range, excellent balance between easiness of formation of toner particles on each surface of which the resin particles are deposited and low temperature fixability of the resin particles of the present disclosure is achieved.

The weight average molecular weight of the resin (a1) is more preferably greater than the weight average molecular weight of the resin (a2) by 1.5 times or greater, and even more preferably greater than the weight average molecular weight of the resin (a2) by 2.0 times or greater.

The weight average molecular weight (Mw) of the resin (a1) is preferably from 20,000 through 20,000,000, and more preferably from 200,000 through 2,000,000. When the weight average molecular weight thereof is 20,000 or greater, favorable preservability is obtained. When the weight average molecular weight thereof is 20,000,000 or less, the resin (a2) does not adversely affect low temperature fixability of the resin particles of the present disclosure.

Mn of the resin (a2) is preferably from 1,000 through 1,000,000. and more preferably from 10,000 through 100,000. When Mn thereof is 1,000 or greater, favorable preservability of the resin particles of the present disclosure is obtained. When Mn thereof is 1,000,000 or less, the resin (a2) does not adversely affect low temperature fixability of the particles of the present disclosure.

Mw of the resin (a2) is preferably from 10,000 through 10,000,000, and more preferably from 100,000 through 1,000,000. When Mw thereof is 10,000 or greater, favorable preservability of the resin particles is obtained. When Mw thereof is 10,000,000 or less, the resin (a2) does not adversely affect low temperature fixability of the resin particles of the present disclosure.

Among the above-listed examples, it is preferred that Mw of the resin (a1) be from 200,000 through 2,000,000, Mw of the resin (a2) be from 100,000 through 500,000, and the resin (a1) and the resin (a2) satisfy the relationship of [Mw of (a1)]>(Mw of (a2)).

In the present disclosure, Mn and Mw can be measured by gel permeation chromatography (GPC) under the following conditions. Device (one example): HLC-8120, available from Tosoh Corporation Columns (one example): 2 columns, TSK GEL GMH6, available from Tosoh Corporation Measuring temperature: 40° C.

Sample solution: 0.25% by weight tetrahydrofuran solution (from which an insoluble component is separated through filtration with a glass filter) Solution injection amount: 100 μL Detection device: refractive index detector Reference materials: 12 samples of standard polystyrene (TSKstandard POLYSTYRENE) (molecular weights: 500, 1,050, 2,800, 5,970, 9,100, 18,100, 37,900, 96,400, 190,000, 355,000, 1,090,000, and 2,890,000) [available from Tosoh Corporation]

The weight ratio of the resin (a1) to the resin (a2) in the organic particles is preferably from 5/95 through 95/5, more preferably from 25/75 through 75/25, and even more preferably from 40/60 through 60/40. When the weight ratio of the resin (a) to the resin (a2) is 5/95 or greater, excellent heat resistant storage stability of the composite resin particles (organic particles) is obtained. When the weight ratio of the resin (a1) to the resin (a2) is 95/5 or less, toner particles on each surface of which the resin particles (organic particles) are deposited are easily formed.

Examples of a method for producing the particles each including, as constitutional components, the resin (a1) and the (a2) per particle include productions methods known in the art. For example, the following production methods (I) to (V) are listed.

(I) A method where constitutional monomers of the resin (a2) are polymerized through seeded polymerization using particles of the resin (a1) in an aqueous dispersion liquid as seeds.

(II) A method where constitutional monomers of the resin (a1) are polymerized through seeded polymerization using particles of the resin (a2) in an aqueous dispersion liquid as seeds.

(III) A method where a mixture of the resin (a1) and the resin (a2) is emulsified with an aqueous medium to obtain an aqueous dispersion liquid of resin particles.

(IV) A method where a mixture of the resin (a1) and constitutional monomers of the resin (a2) is emulsified with an aqueous medium, followed by polymerizing the constitutional monomers of the resin (a2), to is obtain an aqueous dispersion liquid of resin particles.

(V) A method where a mixture of the resin (a2) and constitutional monomers of the resin (a1) is emulsified with an aqueous medium, followed by polymerizing the constitutional monomers of the resin (a1), to obtain an aqueous dispersion liquid of resin particles.

Whether or not the organic particles (A) each include, as constitutional components, the resin (a1) and the resin (b2) per particle can be confirmed by observing an element mapping image of a cross-sectional surface of the organic particles (A) under a known surface elemental analysis device (e.g., TOF-SIMSEDX-SEM), or observing cross-sectional surfaces of the organic particles (A) dyed with a dye that can be used for functional groups included in the resin (a1) and the resin (a2) under an electron microscope.

The resin particles obtained by the above-described method may be a mixture of resin particles each including only the resin (a1) as a constitutional resin component, and resin particles each including only the resin (a2) as a constitutional resin component, other than the resin particles each including, as constitutional components, the resin (a1) and the resin (a2) per particle. In the below-mentioned composite step, the resin particles may be used as the mixture of the resin particles, or only the resin particles may be separated and used.

Specific examples of (I) include: a method where constitutional monomers of (a1) are dripped and polymerized to produce an aqueous dispersion liquid of resin particles including (a1), followed by seeded polymerizing constitutional monomers of (a2) using the resin particles including (a1) as seeds; and a method where (a1), which is produced in advance by solution polymerization etc., is emulsified and dispersed in water, followed by seeded polymerizing constitutional monomers of (a2) using (a1) as seeds.

Specific examples of (II) include: a method where constitutional monomers of (a2) are dripped and polymerized to produce an aqueous dispersion liquid of resin particles, followed by polymerizing constitutional monomers of (a1) using the resin particles as seeds; and a method where (a2), which is produced in advance by solution polymerization etc., is emulsified and dispersed in water, followed by seeded polymerizing constitutional monomers of (a1) using (a2) as seeds.

Specific examples of (III) include a method where solutions or melts of (a1) and (a2), which are produced in advance by solution polymerization, followed by emulsifying and dispersing the resultant into an aqueous medium.

Specific examples of (IV) include: a method where (a1), which is produced in advance by solution polymerization etc., and constitutional monomers of (a2) are mixed, and the resultant mixture is emulsified and dispersed in an aqueous medium, followed by polymerizing the constitutional monomers of (a2); and a method where (a1) is produced in constitutional monomers of (a2), and the resultant mixture is emulsified and dispersed in an aqueous medium, followed by polymerizing the constitutional monomers of (a2).

Specific examples of (V) include: a method where (a2), which is produced in advance by solution polymerization etc., is mixed with constitutional monomers of (a1), and the resultant mixture is emulsified and dispersed in an aqueous medium, followed by polymerizing the constitutional monomers of (a1); and a method where (a2) is produced in constitutional monomers of (a1), and the resultant mixture is emulsified and dispersed in an aqueous medium, followed by polymerizing the constitutional monomers of (a1).

In the present disclosure, any of the production methods (I) to (V) is suitably used.

The organic particles are preferably used in the form of an aqueous dispersion liquid. An aqueous medium used for the aqueous dispersion liquid is not particularly limited as long as the aqueous medium is a liquid including water as an essential constitutional component. Examples thereof include an aqueous solution, in which a surfactant (D) is included in water.

Examples of the surfactant (D) include a nonionic surfactant (D1), an anionic surfactant (D2), a cationic surfactant (D), an amphoteric surfactant (D4), and other emulsification dispersants (D5).

Moreover, optionally an appropriate amount of a buffer (e.g., sodium acetate, sodium citrate, and sodium bicarbonate) or a protective colloid (e.g., a water-soluble cellulose compound, and an alkali metal salt of polymethacrylic acid) may be used. The above-listed examples may be used alone or in combination.

Examples of the nonionic surfactant (D1) include an alkylene oxide (AO) adduct-based nonionic surfactant, and a polyvalent alcohol-based nonionic surfactant.

Examples of the AO adduct-based nonionic surfactant include a C10-C20 aliphatic alcohol EO adduct, a phenol EO adduct, a nonyl phenol ethylene oxide (EO) adduct, a C8-C22 alkyl amine EO adduct, and a poly(oxypropylene) glycol EO adduct.

Examples of the polyvalent alcohol-based nonionic surfactant include polyvalent (tri- through octavalent or higher) alcohol (C2-C30) fatty acid (C8-C24) ester (e.g., glycerin monostearate, glycerin monoolaete, sorbitan monolaurate, and sorbitan monooleate), and alkyl (C4-C24) poly (degree of polymerization: 1 through 10) glucoside.

Examples of the anionic surfactant (D2) include C8-C24 hydrocarbon group-containing ether carboxylic acid or salt thereof, C8-C24 hydrocarbon group-containing sulfuric acid ester or ether sulfuric acid ester and salts thereof, C8-C24 hydrocarbon group-containing is sulfonic acid salt, sulfosuccinic acid salt including one or two C8-C24 hydrocarbon groups, C8-C24 hydrocarbon group-containing phosphoric acid ester or ether phosphoric acid ester and salts thereof, C8-C24 hydrocarbon group-containing fatty acid salt, and C8-C24 hydrocarbon group-containing acylated amino acid salt.

Examples of the C8-C24 hydrocarbon group-containing ether carboxylic acid or salts thereof include sodium lauryl ether acetate, and sodium (poly)oxyethylene (the number of moles added: from 1 through 100) lauryl ether acetate.

Examples of the C8-C24 hydrocarbon group-containing sulfuric acid ester or ether sulfuric acid ester and salts thereof include sodium lauryl sulfate, sodium (poly)oxyethylene (the number of moles added: from 1 through 100) lauryl sulfate, triethanolamine (poly)oxyethylene (the number of moles added: from 1 through 100) lauryl sulfate, and (poly)oxyethylene (the number of moles added: from 1 through 100) coconut fatty acid monoethanolamide sodium sulfate.

Examples of the C8-C24 hydrocarbon group-containing sulfonic acid salt include sodium dodecylbenzene sulfonate.

Examples of the C8-C24 hydrocarbon group-containing phosphoric acid ester or ether phosphoric acid ester and salts thereof include sodium lauryl phosphate, and sodium (poly) oxyethylene (the number of moles added: from 1 through 100) lauryl ether phosphate.

Examples of the C8-C24 hydrocarbon group-containing fatty acid salt include sodium laurate, and triethanolamine laurate.

Examples of the C8-C24 hydrocarbon group-containing acylated amino acid salt include sodium methyl cocoyl taurate, sodium cocoyl sarcosinate, triethanolamine cocoyl sarcosinate, triethanolamine N-cocoyl-L-glutamate, sodium N-cocoyl-L-glutamate, and laurylmethyl-β-alanine sodium salt.

Examples of the cationic surfactant (D3) include a quaternary ammonium salt-based cationic surfactant, and an amine salt-based cationic surfactant.

Examples of the quaternary ammonium salt-based cationic surfactant include trimethylstearylammonium chloride, btrimethyl ammonium chloride, distearyl dimethyl ammonium chloride, and N-(N-lanolin fatty acid amide propyl) N-ethyl-N,N-dimethyl ammonium ethyl sulfate (i.e. Quaternium-33).

Examples of the amine salt-based cationic surfactant include stearic acid diethylaminoethylamide lactic acid salt, dilaurylamine hydrochloride, and oleylamine lactate.

Examples of the amphoteric surfactant (D4) include a betaine-based amphoteric surfactant, and an amino acid-based amphoteric surfactant.

Examples of the betaine-based amphoteric surfactant include is coconut oil fatty acid amidepropyldimethylaminoacetic acid betaine, lauryl dimethylaminoaetic acid betaine, 2-alkyl-N-carboxymethyl-N-hydroxyethylimidazolium betaine, and lauryl hydroxysulfobetaine.

Examples of the amino acid-based amphoteric surfactant include sodiumβ-laurylaminopropionate.

Other Examples of other emulsification dispersants (D5) include a reactive activator. The reactive activator is not particularly limited as long as the reactive activator has radical reactivity. Examples thereof include: ADEKA REASOAP (registered trademark) SE-10N, SR-10, SR-20, SR-30, ER-20, and ER-30 (all available from ADEKA CORPORATION); HITENOL (registered trademark), HS-10, KH-05, KH-10, and KH-1025 (all available from DKS Co., Ltd.); ELEMINOL (registered trademark) JS-20 (available from SANYO CHEMICAL, LTD.); LATEMUL (registered trademark) D-104, PD-420, and PD-430 (available from Kao Corporation); IONET (registered trademark) MO-200 (available from SANYO CHEMICAL, LTD.); polyvinyl alcohol; starch and derivatives thereof; cellulose derivatives, such as carboxymethyl cellulose, methyl cellulose, and hydroxyethyl cellulose; carboxyl group-containing (co)polymer, such as polyacrylic acid soda; and urethane group or ester group-containing emulsification dispersants (e.g., a compound obtained by linking polycaprolactone polyol and polyether diol with polyisocyanate) disclosed in U.S. Pat. No. 5,906,704.

In order to stabilize oil droplets to obtain desired shapes, and to make a particle size distribution sharp during emulsification and dispersion, the surfactant (D) is preferably (D1), (D2), (D5), or a combination thereof, and a combination of (D) and (D5) or a combination of (D2) and (D5) is more preferable.

The resin particles of the present disclosure may each include, in addition to the resin (a1) and the resin (a2), other resin components, an initiator (and a residue thereof, a chain-transfer agent, an antioxidant, a plasticizer, a preservative, a reducing agent, and an organic solvent.

Examples of the above-mentioned other resin components include a vinyl resin excluding the resin used for the resin (a1) and the resin (a2), a polyurethane resin, an epoxy resin, a polyester resin, a polyamide resin, a polyimide resin, a silicon-based resin, a phenol resin, a melamine resin, a urea resin, an aniline resin, an ionomer resin, and a polycarbonate resin.

Examples of the initiator (a residue thereof) include radical polymerization initiators known in the art. Specific examples thereof include: a persulfuric acid salt initiator, such as potassium persulfate, and ammonium persulfate; an azo initiator, such as azobisisobutyronitrile; organic peroxide, such as benzoyl peroxide, cumene hydroperoxide, tert-butyl hydroperoxide, tert-butyl is peroxyisopropyl monocarbonate, and tert-butyl peroxybenzoate; and hydrogen peroxide.

Examples of the chain-transfer agent include n-dodecylmercaptan, tert-dodecylmercaptan, n-butylmercaptan, 2-ethylhexyl thioglycolate, 2-mercaptoethanol, 6-mercaptopropionic acid, and α-methylstyrene dimer.

Examples of the antioxidant include a phenol compound, para-phenylenediamine, hydroquinone, an organic sulfur compound, and an organophosphorus compound.

Examples of the phenol compound include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris-(3,5-di-t-butyl-4-hydroxybenzyl)benzene, tetrakis-[methylene-3-(3', 5'-di-t-butyl-4'-hydroxyphenyl)propionate]methane, bis[3,3'-bis(4'-hydroxy-3'-t-butylphenyl)butyric acid]glycol ester, and tocopherol.

Examples of the para-phenylenediamine include N-phenyl-N'-isopropyl-p-phenylenediamine, N,N'-di-sec-butyl-p-phenylenediamine. N-phenyl-N-sec-butyl-p-phenylenediamine. N,N'-di-isopropyl-p-phenylenediamine, and N,N'-dimethyl-N,N'-di-t-butyl-p-phenylenediamine.

Examples of the hydroquinone include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compound include dilauryl-3,3'-thiodipropionate, distearyl-3,3'-thiodipropionate, and ditetradecyl-3,3'-thiodipropionate.

Examples of the organophosphorus compound include triphenylphosphine, tri(nonylpheny)phosphine, tri(dinonylphenyl)phosphine, tricresyl phosphate, and tri(2,4-dibutylphenoxy)phosphine.

Examples of the plasticizer include phthalic acid ester, aliphatic diprotic acid ester, trimellitic acid ester, phosphoric acid ester, and fatty acid ester. Specific examples of the phthalic acid ester include dibutyl phthalate, dioctyl phthalate, butylbenzyl phthalate, and isodecyl phthalate.

Examples of the aliphatic diprotic acid ester include di-2-ethylhexyl adipate, and 2-ethylhexyl sebacate.

Examples of the trimellitic acid ester include tri-2-ethylhexyl trimellitate, and trioctyl trimellitate.

Examples of the phosphoric acid ester include triethyl phosphate, is tri-2-ethylhexyl phosphate, and tricresyl phosphate.

Examples of the fatty acid ester include butyl oleate.

Examples of the preservative include an organic nitrogen sulfur compound preservative, and an organic sulfur halogenated compound preservative.

Examples of the reducing agent include: a reducing organic compound, such as ascorbic acid, tartaric acid, citric acid, glucose, and formaldehyde sulfoxylate metal salt; and a reducing inorganic compound, such as sodium thio sulfate, sodium sulfite, sodium bisulfite, and sodium metabisulfite.

Examples of the organic solvent include: a ketone solvent, such as acetone, and methyl ethyl ketone (may be abbreviated as MEK hereinafter); an ester solvent, such as ethyl acetate, and γ-butyrolactone; an ether solvent, such as tetrahydrofuran (THF); an amide solvent, such as N,N-dimethylformamide, N,N-dimethylacetamide, N-methyl-2-pyrrolidone, and N-methylcaprolactam; an alcohol solvent, such as isopropyl alcohol; and an aromatic hydrocarbon solvent, such as toluene, and xylene.

<Other Toner Raw Materials>

The toner includes, for example, color particles each including a binder resin, a colorant, and a release agent. The color particles may further include other components according to the necessity. Moreover, is inorganic particles, e.g., metal oxide, are added as an external additive to each of the color particles.

<<Crystalline Resin>>

In the present specification, the term "crystallinity" of the crystalline resin means characteristics that a ratio (softening point/the maximum peak temperature of heat of fusion) of a softening temperature measured by a capillary flowtester to the maximum peak temperature of heat of fusion measured by a differential scanning calorimeter (DSC) is preferably from 0.80 through 1.55, and the resin is sharply softened by heat. A resin having such characteristics is referred to as a "crystalline resin."

Moreover, the term "amorphous" means characteristics that a ratio (softening point/the maximum peak temperature of heat of fusion) of the softening temperature and the maximum peak temperature of heat of fusion is greater than 1.55, and the resin is gradually softened by heat. Moreover, a resin having such characteristics is referred to as an "amorphous resin."

A softening temperature of the resin or the toner can be measured by means of a capillary flowtester (e.g., CFT-500D, available from Shimadzu Corporation). As a sample, 1 g of a resin is used. A load (30 kg/cm$^2$) is applied to the sample by a plunger with heating the sample at the heating rate of 3° C./min to extrude from a nozzle having a is diameter of 0.5 mm and a length of 1 mm. The lowered amount of the plunger of the flowtester relative to the temperature is plotted, and the temperature at which a half of the sample is extruded is determined as a softening temperature.

The maximum peak temperature of heat of fusion of the resin or the toner can be measured by means of a differential scanning calorimeter (DSC) (e.g., TA-60WS and DSC-60, available from Shimadzu Corporation). As a pre-treatment, a sample provided for the measurement of the maximum peak temperature of heat of fusion is melted at 130° C., and then cooled from 130° C. to 70° C. at the cooling rate of 1.0° C./min, followed by cooling from 70° C. to 10° C. at the cooling rate of 0.5° C./min. Then, the endothermic and exothermic energy change of the sample is measured by heating at the heating rate of 20° C./min by DSC to draw a graph depicting a relationship between "endothermic and exothermic energy value" and the "temperature." The endothermic peak temperature observed in the range of 20° C. to 100° C. on the drawn graph is determined as the endothermic peak temperature "Ta*." In the case where are several endothermic peaks within the above-mentioned range, the temperature of the peak having the largest endothermic value is determined as "Ta*." Thereafter, the sample is stored for 6 hours at a temperature of (Ta*−10°) C, followed by storing for further 6 hours at (Ta*−15°) C. Subsequently, the sample is cooled to 0° C. at the cooling is rate of 10° C./min, followed by heating at the heating rate of 20° C./min by DSC to measure the endothermic and exothermic energy change to draw a graph similarly to the above-mentioned graph. The temperature corresponding to the maximum peak of the endothermic and exothermic energy value is determined as the maximum peak temperature of heat of fusion of the second heating.

The energy value of heat of fusion calculated from an area (peak area) from the temperature at which the heat absorption starts to the temperature at which the heat absorption ends.

<<Crystalline Polyester Resin>>

The crystalline polyester resin (may be referred to as a "crystalline polyester resin C" hereinafter) has high crystallinity, and therefore the crystalline polyester resin has heat fusion characteristics that viscosity thereof drastically changes at a temperature around a fixing onset temperature. By using the crystalline polyester resin C having the above-described characteristics in combination with an amorphous polyester resin, a toner having both excellent heat resistant storage stability and low-temperature fixability can be obtained. By using the crystalline polyester resin C and the amorphous polyester resin in combination, for example, excellent heat resistant storage stability can be secured up to at a temperature just below the melt onset temperature owing to crystallinity of the crystalline polyester resin C, and drastic reduction in viscosity (sharp melting) is caused at the melt onset temperature owing to melting of the crystalline polyester resin C. As a result of sharp melting, the crystalline polyester resin C becomes compatible with the below-described amorphous polyester resin B, and the viscosity is drastically reduced. Therefore, excellent fixing can be performed. Moreover, an excellent release width (a difference between the minimum fixing temperature and a hot offset onset temperature) is also obtained.

The crystalline polyester resin C is obtained using polyvalent alcohol, and polyvalent carboxylic acid or a derivative thereof (e.g., polyvalent carboxylic acid, polyvalent carboxylic acid anhydride, and polyvalent carboxylic acid ester).

In the present disclosure, the crystalline polyester resin C is a resin obtained using polyvalent alcohol, and polyvalent carboxylic acid or a derivative thereof (e.g., polyvalent carboxylic acid, polyvalent carboxylic acid anhydride, and polyvalent carboxylic acid ester). A modified polyester resin, such as a below-described prepolymer and a resin obtained through a crosslink reaction and/or an elongation reaction of the prepolymer, is not classified as the crystalline polyester resin C.

—Polyvalent Alcohol—

The polyvalent alcohol is not particularly limited and may be appropriately selected depending on the intended purpose. Examples of the polyvalent alcohol include diol, and trivalent or higher alcohol.

Examples of the diol include saturated aliphatic diol. Examples of the saturated aliphatic diol include straight-chain saturated aliphatic diol, and branched saturated aliphatic diol. Among the above-listed example, straight-chain saturated aliphatic diol is preferable, and C2-C12 straight-chain saturated aliphatic diol is more preferable. When the saturated aliphatic diol has a branched-chain molecular structure, crystallinity of the crystalline polyester resin C is low, and a melting point thereof may be low. When the number of carbon atoms in the saturated aliphatic diol is greater than 12, moreover, it may be difficult to source materials for use. The number of carbon atoms is preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among the above-listed examples, ethylene glycol, 1,4-butanediol, 1,6-hexanediol, 1,8-octanediol, 1,10-decanediol, and 1,12-dodecanediol are preferable because high crystallinity of the crystalline polyester resin C and excellent sharp is melting properties can be obtained.

Examples of the trivalent or higher alcohol include glycerin, trimethylol ethane, trimethylol propane, and pentaerythritol.

The above-listed examples may be used alone or in combination.

—Polyvalent Carboxylic Acid—

The polyvalent carboxylic acid is not particularly limited and may be appropriately selected depending on the intended purpose. Examples of the polyvalent carboxylic acid include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid, such as dibasic acid (e.g., phthalic acid, isophthalic acid, terephthalic acid, and naphthalene-2,6-dicarboxylic acid); malonic acid, and mesaconic acid; anhydrides thereof: and lower (C1-C3) alkyl esters thereof.

Examples of the trivalent or higher carboxylic acid include 1,2,4-benzenetricarboxylic acid, 1,2,5-benzenetricarboxylic acid, 1,2,4-naphthalenetricarboxylic acid, anhydrides thereof, and lower (C1-03) is alkyl esters thereof.

As well as the saturated aliphatic dicarboxylic acid or aromatic dicarboxylic acid, moreover, dicarboxylic acid having a sulfonic acid group may be included as the polyvalent carboxylic acid. As well as the saturated aliphatic dicarboxylic acid or aromatic dicarboxylic acid, furthermore, dicarboxylic acid having a double bond may be included.

The above-listed examples may be used alone or in combination.

The crystalline polyester resin C is preferably formed from C4-C12 straight-chain saturated aliphatic dicarboxylic acid and C2-C12 straight-chain saturated aliphatic diol. Specifically, the crystalline polyester resin C preferably includes a constitutional unit derived from C4-C12 saturated aliphatic dicarboxylic acid and a constitutional unit derived from C2-C12 saturated aliphatic diol. Such a crystalline polyester resin C is preferable because excellent sharp melting properties can be imparted to a resultant toner to exhibit excellent low-temperature fixability.

The melting point of the crystalline polyester resin C is not particularly limited and may be appropriately selected depending on the intended purpose. The melting point of the crystalline polyester resin C is preferably 60° C. or higher but 80° C. or lower. When the melting point is lower than 60° C., the crystalline polyester resin C tends to melt at a low temperature to degrade heat resistant storage stability of a resultant toner. When the meting point of the crystalline polyester resin C is higher than 80° C., the crystalline polyester resin C does not sufficiently melt with heat applied during fixing to degrade low temperature fixability of a resultant toner.

The molecular weight of the crystalline polyester resin C is not particularly limited and may be appropriately selected depending on the intended purpose. Considering that the crystalline polyester resin C having a sharp molecular weight distribution and a low molecular weight imparts excellent low-temperature fixability, and a large amount of the low molecular weight components may degrade heat resistant storage stability, the ortho-dichlorobenzene soluble component of the crystalline polyester resin C as measured by GPC preferably has a weight average molecular weight (Mw) of from 3,000 through 30,000, a number average molecular weight (Mn) of from 1,000 through 10,000, and a ratio Mw/Mn of from 1.0 through 10. Moreover, the weight average molecular weight (Mw) is preferably from 5,000 through 15,000, the number average molecular weight (Mn) is preferably from 2,000 through 10,000, and the ratio Mw/Mn is preferably from 1.0 through 5.0.

The acid value of the crystalline polyester resin C is not particularly limited and may be appropriately selected depending on the intended purpose. In order to achieve desired low-temperature fixability in view of affinity between paper and the resin, the acid value thereof is is preferably 5 mgKOH/g or greater, and more preferably 10 mgKOH/g or greater. In order to improve hot offset resistance, the acid value thereof is preferably 45 mgKOH/g or less.

The hydroxyl value of the crystalline polyester resin C is not particularly limited and may be appropriately selected depending on the intended purpose. In order to achieve desired low-temperature fixability and excellent charging characteristics, the hydroxyl value thereof is preferably from 0 mgKOH/g through 50 mgKOH/g, and more preferably from 5 mgKOH/g through 50 mgKOH/g.

The molecular structure of the crystalline polyester resin C can be confirmed by solution or solid NMR spectroscopy. X-ray diffraction spectroscopy, GC/MS, LC/MS, or IR spectroscopy. As a simple method for confirming the molecule structure thereof, there is a method for detecting, as the crystalline polyester resin C, a compound having absorption, which is based on CH (out plane bending) of olefin, at 965±10 $cm^{-1}$ or 990±10 $cm^{-1}$ in an infrared absorption spectrum thereof.

The amount of the crystalline polyester resin C is not particularly limited and may be appropriately selected depending on the intended purpose. The amount of the crystalline polyester resin C is preferably from 3 parts by mass through 20 parts by mass, and more preferably from parts by mass through 15 parts by mass, relative to 100 parts by mass of the toner. When the amount thereof is less than 3 parts by mass, is sharp-melt properties of a resultant toner owing to the crystalline polyester resin C cannot be sufficiently exhibit, and therefore low-temperature fixability may not be sufficient. When the amount thereof is greater than 20 parts by mass, heat resistant storage stability may be low, and image fogging tends to occur. The amount of the crystalline polyester resin C within the above-mentioned more preferable range is advantageous because both excellent image quality and excellent low temperature fixability are obtained.

<<Amorphous Polyester Resin>>

The amorphous polyester resin is not particularly limited and may be appropriately selected depending on the intended purpose. The amorphous polyester resin preferably includes an amorphous polyester resin A and an amorphous polyester resin B, which will be described hereinafter.

<<Amorphous Polyester Resin A>>

The amorphous polyester resin A is not particularly limited and may be appropriately selected depending on the intended purpose. The amorphous polyester resin A preferably has a glass transition temperature (Tg) of −40° C. or higher but 20° C. or lower.

The amorphous polyester resin A is not particularly limited and may be appropriately selected depending on the intended purpose. The amorphous polyester resin A is preferably obtained through a reaction is between a non-linear reactive precursor and a curing agent. Moreover, the amorphous polyester resin A preferably has a urethane bond, or a urea bond, or both considering excellent adhesion to a recording medium, such as paper. Since the amorphous polyester resin A includes a urethane bond or a urea bond, the urethane bond or the urea bond behaves as a pseudo-crosslinking point to enhance rubber-like characteristics of the amorphous polyester resin A, and therefore heat resistant storage stability and hot offset resistance of a resultant toner improve.

—Non-Linear Reactive Precursor—

The non-linear reactive precursor is not particularly limited as long as the non-linear reactive precursor is a polyester resin having a group reactive with the curing agent (may be referred to as a "prepolymer" hereinafter), and may be appropriately selected depending on the intended purpose.

Examples of the group included in the prepolymer, which is reactive with the curing agent, include a group reactive with an active hydrogen group.

Examples of the group reactive with an active hydrogen group include an isocyanate group, an epoxy group, carboxylic acid, and an acid chloride group. Among the above-listed examples, an isocyanate group is preferable because a urethane bond or a urea bond can be introduced to a resultant amorphous polyester resin A.

The prepolymer is preferably a non-linear prepolymer. The non-linear prepolymer means a prepolymer having a branched structure imparted by at least one selected from the group consisting of trivalent or higher alcohol and trivalent or higher carboxylic acid. Moreover, the prepolymer is preferably an isocyanate group-containing polyester resin.

---Isocyanate Group-Containing Polyester Resin---

The isocyanate group-containing polyester resin is not particularly limited, and may be appropriately selected depending on the intended purpose. Examples thereof include a reaction product between an active hydrogen group-containing polyester resin and polyisocyanate. For example, the active hydrogen group-containing polyester resin is obtained through polycondensation between diol, dicarboxylic acid, and at least one selected from the group consisting of trivalent or higher alcohol and trivalent or higher carboxylic acid. The trivalent or higher alcohol and the trivalent or higher carboxylic acid impart a branched structure to the isocyanate group-containing polyester resin.

---Diol---

The diol is not particularly limited, and may be appropriately selected depending on the intended purpose. Examples thereof include: aliphatic diol, such as ethylene glycol, 1,2-propylene glycol, 1,3-propylene glycol, 1,4-butanediol, 3-methyl-1,5-pentadiol, 1,6-hexanediol, 1,8-octanediol, 1,10-decanediol, and 1,12-dodecane; oxyalkylene group-containing diol, such as diethylene glycol, triethylene glycol, dipropylene glycol, polyethylene glycol, polypropylene glycol, and polytetrametylene glycol; alicyclic diol, such as 1,4-cyclohexanedimethanol, and hydrogenated bisphenol A; alkylene oxide (e.g., ethylene oxide, propylene oxide, and butylene oxide) of alicyclic diol; bisphenols, such as bisphenol A, bisphenol F, and bisphenol S; and alkylene oxide adducts of bisphenol, such as bisphenols to which alkylene oxide (e.g., ethylene oxide, propylene oxide, and butylene oxide) is added. Among the above-listed examples, C4-C12 aliphatic diol is preferable.

The above-listed diols may be used alone or in combination.

---Dicarboxylic Acid---

The dicarboxylic acid is not particularly limited and may be appropriately selected depending on the intended purpose. Examples of the dicarboxylic acid include aliphatic dicarboxylic acid, and aromatic dicarboxylic acid. Moreover, anhydrides thereof may be used, lower (C1-C3) alkyl esters thereof may be used, or halogenated products thereof may be used.

The aliphatic dicarboxylic acid is not particularly limited and may be appropriately selected depending on the intended purpose. Examples of the aliphatic dicarboxylic acid include succinic acid, adipic acid, sebacic acid, dodecanedioic acid, maleic acid, and fumaric acid.

The aromatic dicarboxylic acid is not particularly limited and may be appropriately selected depending on the intended purpose. The aromatic dicarboxylic acid is preferably C8-C20 aromatic dicarboxylic acid. The C8-C20 aromatic dicarboxylic acid is not particularly limited and may be appropriately selected depending on the intended purpose. Examples of the C8-C20 aromatic dicarboxylic acid include phthalic acid, isophthalic acid, terephthalic acid, and naphthalene dicarboxylic acid.

Among the above-listed examples, C4-C12 aliphatic dicarboxylic acid is preferable.

The above-listed dicarboxylic acids may be used alone or in combination.

---Trivalent or Higher Alcohol---

The trivalent or higher alcohol is not particularly limited and may be appropriately selected depending on the intended purpose. Examples of the trivalent or higher alcohol include trivalent or higher aliphatic alcohol, trivalent or higher polyphenols, and alkylene oxide adducts of trivalent or higher polyphenols.

Examples of the trivalent or higher aliphatic alcohol include glycerin, trimethylolethane, trimethylolpropane, pentaerythritol, and sorbitol.

Examples of the trivalent or higher polyphenols include trisphenol PA, phenolic novolac, and cresol novolac.

Examples of the alkylene oxide adduct of trivalent or higher polyphenols include alkylene oxide (e.g., ethylene oxide, propylene oxide, and butylene oxide) adducts of trivalent or higher polyphenols.

The amorphous polyester resin A preferably includes trivalent or higher aliphatic alcohol as a constitutional component. Since the amorphous polyester resin A includes trivalent or higher aliphatic alcohol as a constitutional component, a molecular skeleton of the amorphous polyester resin A has a branched structure, and the molecular chain thereof has a three-dimensional network structure. Therefore, the amorphous polyester resin A has rubber-like characteristics that the amorphous polyester A deforms but does not flow at a low temperature. Use of the amorphous polyester resin A can achieve both heat resistant storage stability and hot offset resistance of a resultant toner.

The amorphous polyester resin A can use trivalent or higher carboxylic acid or epoxy as a crosslink component therein. When the carboxylic acid is used as the crosslink component, the compound including such a crosslink component is often an aromatic compound, or an ester bond density of the crosslink site is high, and therefore a resultant toner may not achieve sufficient gloss when the toner is fixed with heat and formed into a fixed image. When a crosslinking agent, such as epoxy, is used, a cross-linking reaction is performed after polymerization of polyester. Therefore, it is difficult to control a distance is between crosslink points thus target viscoelasticity cannot be obtained. As the epoxy tends to react with oligomers during formation of polyester to form sites having high crosslink density, a fixed image tends to be uneven, leading to impaired glossiness or image density.

---Trivalent or Higher Carboxylic Acid---

The trivalent or higher carboxylic acid is not particularly limited, and may be appropriately selected depending on the intended purpose. Examples thereof include trivalent or higher aromatic carboxylic acid. Moreover, anhydrides thereof may be used, lower (C1-C3) alkyl esters thereof may be used, or halogenated products thereof may be used.

The trivalent or higher aromatic carboxylic acid is preferably C9-C20 trivalent or higher aromatic carboxylic acid. Examples of the C9-C20 trivalent or higher aromatic carboxylic acid include trimellitic acid, and pyromellitic acid.

---Polyisocyanate---

The polyisocyanate is not particularly limited, and may be appropriately selected depending on the intended purpose. Examples thereof include diisocyanate, and trivalent or higher isocyanate.

Examples of the diisocyanate include aliphatic diisocyanate, alicyclic diisocyanate, aromatic diisocyanate, aromatic aliphatic diisocyanate, isocyanurates, and any of the above-listed diisocyanates blocked with a phenol derivative, oxime, or caprolactam.

The aliphatic diisocyanate is not particularly limited, and may be appropriately selected depending on the intended purpose. Examples thereof include tetramethylene diisocyanate, hexamethylene diisocyanate, 2,6-diisocyanatocaproic acid methyl ester, octamethylene diisocyanate, decamethylene diisocyanate, dodecamethylene diisocyanate, tetradecamethylene diisocyanate, trimethylhexanediisocyanate, and tetramethylhexane diisocyanate.

The alicyclic diisocyanate is not particularly limited, and may be appropriately selected depending on the intended purpose. Examples thereof include isophorone diisocyanate, and cyclohexylmethane diisocyanate.

The aromatic diisocyanate is not particularly limited, and may be appropriately selected depending on the intended purpose. Examples thereof include tolylene diisocyanate, diisocyanatodiphenyl methane, 1,5-naphthylenediisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

The aromatic aliphatic diisocyanate is not particularly limited, and may be appropriately selected depending on the intended purpose. Examples thereof include $\alpha,\alpha,\alpha',\alpha'$-tetramethylxylylenediisocyanate.

The isocyanurate is not particularly limited, and may be appropriately selected depending on the intended purpose. Examples thereof include tris(isocyanatalkyl)isocyanurate, and tris(isocyanatocycloalkyl)isocyanurate.

The above-listed polyisocyanates may be used alone or in combination.

—Curing Agent—

The curing agent is not particularly limited as long as the curing agent is a curing agent capable of reacting with the non-linear reactive precursor to generate the amorphous polyester resin A. The curing agent may be appropriately selected depending on the intended purpose. Examples of the curing agent include an active hydrogen group-containing compound.

--Active Hydrogen Group-Containing Compound--

An active hydrogen group in the active hydrogen group-containing compound is not particularly limited, and may be appropriately selected depending on the intended purpose. Examples of the active hydrogen group include a hydroxyl group (e.g., an alcoholic hydroxyl group, and a phenolic hydroxyl group), an amino group, a carboxyl group, and a mercapto group. The above-listed examples may be used alone or in combination.

The active hydrogen group-containing compound is not particularly limited, and may be appropriately selected depending on the intended purpose. The active hydrogen group-containing compound is preferably amines because a urea bond can be formed.

The amines are not particularly limited, and may be appropriately selected depending on the intended purpose. Examples thereof include diamine, trivalent or higher amine, amino alcohol, aminomercaptan, amino acid, and any of the above-listed amines in which an amino group is blocked.

The above-listed examples may be used alone or in combination.

Among the above-listed examples, diamine, and a mixture of diamine and a small amount of trivalent or higher amine are preferable.

The diamine is not particularly limited, and may be appropriately selected depending on the intended purpose. Examples of the diamine include aromatic diamine, alicyclic diamine, and aliphatic diamine. The aromatic diamine is not particularly limited, and may be appropriately selected depending on the intended purpose. Examples thereof include phenylene diamine, diethyltoluene diamine, and 4,4'-diaminodiphenylmethane.

The alicyclic diamine is not particularly limited, and may be appropriately selected depending on the intended purpose. Examples thereof include 4,4'-diamino-3,3'-dimethyldicyclohexylmethane, diaminocyclohexane, and isophorone diamine.

The aliphatic diamine is not particularly limited, and may be appropriately selected depending on the intended purpose. Examples thereof include ethylene diamine, tetramethylene diamine, and hexamethylene diamine.

The trivalent or higher amine is not particularly limited, and may be appropriately selected depending on the intended purpose. Examples thereof include diethylene triamine, and triethylene tetramine.

The amino alcohol is not particularly limited, and may be appropriately selected depending on the intended purpose. Examples thereof include ethanolamine, and hydroxyethylaniline.

The aminomercaptan is not particularly limited, and may be appropriately selected depending on the intended purpose. Examples thereof include aminoethyl mercaptan, and aminopropyl mercaptan.

The amino acid is not particularly limited, and may be appropriately selected depending on the intended purpose. Examples thereof include amino propionic acid, and amino caproic acid.

The amine in which an amino group is blocked is not particularly limited, and may be appropriately selected depending on the intended purpose. Examples thereof include ketimine compounds and oxazoline compounds obtained by blocking an amino group with any of ketones, such as acetone, methyl ethyl ketone, and methyl isobutyl ketone.

The amorphous polyester resin A includes a diol component as a constitutional component, and the diol component preferably includes C4-C12 aliphatic diol in the amount of 50% by mass or greater. In this case, Tg of the amorphous polyester resin A can be maintained low to secure deformable characteristics at low temperatures.

Moreover, the amorphous polyester resin A preferably includes 50% by mass or greater of C4-C12 aliphatic diol relative to the entire alcohol component. In this case, Tg of the amorphous polyester resin A can be maintained low to secure deformable characteristics at low temperatures.

The amorphous polyester resin A preferably includes a dicarboxylic acid component as a constitutional unit, and the dicarboxylic acid component preferably includes C4-C12 aliphatic dicarboxylic acid in the amount of 50% by mass or greater. In this case, Tg of the amorphous polyester resin A can be maintained low to secure deformable characteristics at low temperatures.

A weight average molecular weight of the amorphous polyester resin A is not particularly limited, and may be appropriately selected depending on the intended purpose. The weight average molecular weight of the amorphous polyester resin A as measured by gel permeation chromatography (GPC) is preferably 20,000 or greater but 1,000,000 or less, more preferably 50,000 or greater but 300,000 or less, and particularly preferably 100,000 or greater but 200.000 or less. When the weight average molecular weight of the amorphous polyester resin A is less than 20,000, a resultant toner tends to flow at low temperatures and therefore heat resistant storage stability of a resultant toner may be impaired. In addition, viscosity of a resultant toner becomes low, and hot offset resistance may be impaired.

A molecular structure of the amorphous polyester resin A can be confirmed by solution or solid NMR spectroscopy, X-ray diffraction spectroscopy, GC/MS, LC/MS, or IR spectroscopy. As a simple method for confirming the molecular structure thereof, there is a method for detecting, as the amorphous polyester resin, a compound that does not have absorption, which is based on δCH (out plane bending) of olefin, at 965±10 $cm^{-1}$ or 990±10 $cm^{-1}$ in an infrared absorption spectrum thereof.

An amount of the amorphous polyester resin A is not particularly limited, and may be appropriately selected depending on the intended purpose. The amount thereof is preferably from 5 parts by mass through parts by mass, and more preferably from 10 parts by mass through 20 parts by mass, relative to 100 parts by mass of the toner. When the amount thereof is less than 5 parts by mass, low-temperature fixability and hot offset resistance may be impaired. When the amount thereof is greater than 25 parts by mass, heat resistant storage stability may be impaired, and glossiness of an image obtained after fixing may be low. The amount within the above-described more preferable range is advantageous because a resultant toner excels in all of low-temperature fixability, hot offset resistance, and heat resistant stability.

<<Amorphous Polyester Resin B>>

For example, the amorphous polyester resin B has a glass transition temperature (Tg) of 40° C. or higher but 80° C. or lower.

The amorphous polyester resin B is preferably a linear polyester resin.

The amorphous polyester resin B is preferably an unmodified polyester resin. The unmodified polyester resin is a polyester resin obtained from polyvalent alcohol and polyvalent carboxylic acid (e.g., polyvalent carboxylic acid, polyvalent carboxylic acid anhydride, and polyvalent carboxylic acid ester) or a derivative thereof. Moreover, the unmodified polyester resin is a polyester resin that is not modified with an isocyanate compound etc.

The amorphous polyester resin B is preferably free from a urethane bond and a urea bond.

The amorphous polyester resin B includes a dicarboxylic acid component as a constitutional component thereof, and the dicarboxylic acid component preferably includes terephthalic acid in the amount of 50 i0 mol % or greater. The dicarboxylic acid component including 50 mol % or greater of terephthalic acid is advantageous considering heat resistant storage stability of a resultant toner.

Examples of the polyvalent alcohol include diol.

Examples of the diol include (C2-C3) alkylene oxide adducts (average number of moles added: from 1 through 10) of bisphenol A (e.g., polyoxypropylene (2.2)-2,2-bis(4-hydroxyphenyl)propane, and polyoxyethylene(2.2)-2,2-bis(4-hydroxyphenyl)propane) ethylene glycol), propylene glycol, hydrogenated bisphenol A. (C2-C3) alkylene oxide adducts (average number of moles added: from 1 through 10) of hydrogenated bisphenol A.

The above-listed examples may be used alone or in combination.

Examples of the polyvalent carboxylic acid include dicarboxylic acid.

Examples of the dicarboxylic acid include adipic acid, phthalic acid, isophthalic acid, terephthalic acid, fumaric acid, maleic acid, and succinic acid substituted with a C1-C20 alkyl group or a C2-C20 alkenyl group (e.g., dodecenylsuccinic acid, and octylsuccinic acid).

The above-listed examples may be used alone or in combination.

For the purpose of adjusting the acid value and the hydroxyl value, moreover, the amorphous polyester resin B may include at least one selected from the group consisting of trivalent or higher carboxylic acid, and trivalent or higher alcohol at a terminal of a molecular chain of the amorphous polyester resin B.

Examples of the trivalent or higher carboxylic acid include trimellitic acid, pyromellitic acid, and acid anhydrides thereof.

Examples of the trivalent or higher alcohol include glycerin, pentaerythritol, and trimethylolpropane.

A molecular weight of the amorphous polyester resin B is not particularly limited and may be appropriately selected depending on the intended purpose. When the molecular weight thereof is too small, heat resistant storage stability of a resultant toner and durability thereof against stress (e.g., stress applied by stirring the toner inside a developing device) may be impaired. When the molecular weight thereof is too large, viscoelasticity of a resultant toner during melting may be undesirable. Therefore, a weight average molecular weight (Mw) of the amorphous polyester resin B as measured by gel permeation chromatography (GPC) is preferably from 3,000 through 10,000. A number average molecular weight (Mn) thereof is preferably from 1,000 through 4,000. A ratio Mw/Mn is preferably from 1.0 through 4.0.

The weight average molecular weight (Mw) is more preferably from 4,000 through 7,000. The number average molecular weight (Mn) is more preferably from 1,500 through 3,000. The ratio Mw/Mn is more preferably from 1.0 through 3.5.

An acid value of the amorphous polyester resin B is not particularly limited, and may be appropriately selected depending on the intended purpose. The acid value thereof is preferably from 1 mgKOH/g through 50 mgKOH/g, and more preferably from 5 mgKOH/g through 30 mgKOH/g. When the acid value is 1 mgKOH/g or greater, a resultant toner tends to be negatively charged to improve affinity between paper and the toner when the toner is fixed on the paper, and therefore low-temperature fixability can be improved. When the acid value is greater than 50 mgKOH/g, charging stability, particularly charging stability against environmental fluctuations, may be impaired.

A hydroxyl value of the amorphous polyester resin B is not particularly limited, and may be appropriately selected depending on the intended purpose. The hydroxyl value thereof is preferably 5 mgKOH/g or greater.

A glass transition temperature (Tg) of the amorphous polyester resin B is preferably 40° C. or higher but 80° C. or lower, and more preferably 50° C. or higher but 70° C. or lower. When the glass transition temperature thereof is 40° C. or higher, sufficient heat resistant storage stability and sufficient durability of a resultant toner against stress (e.g., stress applied by stirring inside a developing device) can be obtained, and excellent anti-filming properties can be obtained. When the glass transition temperature thereof is 80° C. or lower, a resultant toner is sufficiently deformed by heat and pressure applied during fixing, and excellent low-temperature fixability is obtained.

A molecular structure of the amorphous polyester resin B can be confirmed by solution or solid NMR spectroscopy, X-ray diffraction spectroscopy, GC/MS, LC/MS, or IR spectroscopy. As a simple method is for confirming, as the amorphous polyester resin, the molecular structure thereof, there is a method for detecting a compound that does not have absorption, which is based on δCH (out plane bending) of olefin, at 965±10 $cm^{-1}$ or 990±10 $cm^{-1}$ in an infrared absorption spectrum thereof.

An amount of the amorphous polyester resin B is not particularly limited, and may be appropriately selected depending on the intended purpose. The amount thereof is preferably from 50 parts by mass through 90 parts by mass, and more preferably from 60 parts by mass through 80 parts by mass, relative to 100 parts by mass of the toner. When the amount of the amorphous polyester resin B is less than 50 parts by mass, dispersibility of a pigment and a release agent in a resultant toner may be impaired to cause fogging or disturbance of an image. When the amount thereof is greater than 90 parts by mass, the amounts of the crystalline polyester resin C and the amorphous polyester resin A are insufficient to impair low-temperature fixability. The amount of the amorphous polyester resin B within the more preferable range is advantageous because excellent image quality and low-temperature fixability are both obtained.

In order to further improve low-temperature fixability, the amorphous polyester resin A is preferably used in combination with the crystalline polyester resin C. In order to achieve both low-temperature fixability and stability at high temperatures and high humidity, a glass transition temperature of the amorphous polyester resin A is preferably very low. Since the glass transition temperature of the amorphous polyester resin A is very low, the amorphous polyester resin A has characteristics that the amorphous polyester resin A deforms at a low temperature. Therefore, a resultant toner has characteristics that the toner deforms upon application of heat and pressure applied during fixing, and therefore the toner is easily adhered to paper at a low temperature. Since the reactive precursor has a non-linear molecular structure according one embodiment of the amorphous polyester resin A, the amorphous polyester resin A has a branched structure in a molecule skeleton and a molecular chain thereof has a three-dimensional network structure. Therefore, the amorphous polyester resin A has rubber-like characteristics that the amorphous polyester resin A deforms but does not flow at a low temperature. Accordingly, a resultant toner can maintain heat resistant storage stability and hot offset resistance.

When the amorphous polyester resin A has a urethane bond or urea bond having high cohesive energy, excellent adhesion of a resultant toner to a recording medium, such as paper, is achieved. Since the urethane bond or the urea bond behaves as a pseudo-crosslinking point to enhance rubber-like characteristics of the amorphous polyester resin A, heat resistant storage stability and hot offset resistance of a resultant toner improve.

Specifically, the toner of the present disclosure has excellent low-temperature fixability when the amorphous polyester resin A, the crystalline polyester resin C, and optionally another amorphous polyester resin B are used in combination. Since the amorphous polyester resin A having a glass transition temperature in a low temperature range is used in the toner, moreover, the toner can maintain desirable heat resistant storage stability and hot offset resistance even through the glass transition temperature of the toner of the present disclosure is lower than a glass transition temperature of a toner in the related art, and the toner of the present disclosure has excellent low-temperature fixability because the toner has a low glass transition temperature.

<<Other Components>>

Examples of the above-mentioned other components included in the color particles include a release agent, a colorant, a charge controlling agent, a flowability improving agent, a cleaning improving agent, and a magnetic material.

—Release Agent—

The release agent is not particularly limited and may be appropriately selected from release agents known in the art.

Examples of the release agent (e.g., wax) include natural wax, such as vegetable wax (e.g., carnauba wax, cotton wax, and Japanese wax), animal wax (e.g., bees wax and lanolin wax), mineral wax (e.g., ozokerite and ceresin), and petroleum wax (e.g., paraffin wax, microcrystalline wax, and petrolatum wax).

Moreover, the examples include, in addition to the above-listed natural wax, synthetic hydrocarbon wax (e.g., Fischer-Tropsch wax, polyethylene wax, and polypropylene wax), and synthetic wax (e.g., ester, ketone, and ether).

Furthermore, usable may be fatty acid amide-based compounds (e.g., 12-hydroxystearic acid amide, stearic acid amide, phthalimide anhydride, and chlorinated hydrocarbon), a low molecular-weight crystalline polyester resin, such as a homopolymer of polyacrylate (e.g., poly-n-stearylmethacrylate, and poly-n-laurylmethacrylate) or copolymer thereof (e.g., n-stearylacrylate-ethylmethacrylate copolymer), and a crystalline polymer having a long alkyl chain at a side chain thereof.

Among the above-listed examples, hydrocarbon wax, such as paraffin wax, microcrystalline wax, Fischer-Tropsch wax, polyethylene wax, and polypropylene wax, is preferable.

A melting point of the release agent is not particularly limited, and may be appropriately selected depending on the intended purpose. The melting point thereof is preferably 60° C. or higher but 80° C. or lower. When the melting point thereof is lower than 60° C., the release agent tends to melt at a low temperature and therefore heat resistant storage stability of a resultant toner may be impaired. When the melting point thereof is higher than 80° C., the release agent is not sufficiently melted at a fixing temperature range where the resin melts to be fixed to cause fixing offset, and therefore defected images may be formed.

An amount of the release agent is not particularly limited, and may be appropriately selected depending on the intended purpose. The amount of the release agent is preferably from 2 parts by mass through parts by mass, and more preferably from 3 parts by mass through 8 parts by mass, relative to 100 parts by mass of the toner. When the amount thereof is less than 2 parts by mass, hot offset resistance during fixing and desirable low-temperature fixability may be impaired. When the amount thereof is greater than 10 parts by mass, heat resistant storage stability may be impaired, and image fogging may be caused. The amount of the release agent within the more preferable range is advantageous because image quality and fixing stability are improved.

—Colorant—

The colorant is not particularly limited and may be appropriately selected depending on the intended purpose. Examples of the colorant include carbon black, a nigrosine dye, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), Vulcan fast yellow (5G. R), tartrazine lake, is quinoline yellow lake, anthrasan yellow BGL, isoindolinon yellow, red iron oxide, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B. BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited, and may be appropriately selected depending on the intended purpose. The amount of the colorant is preferably from 1 part by mass through 15 parts by mass, and more preferably from 3 parts by mass through 10 parts by mass, relative to 100 parts by mass of the toner.

The colorant may be also used as a master batch in which the colorant forms a composite with a resin. Examples of a resin used for production of the master batch or kneaded together with the master batch include, in addition to the amorphous polyester resin: polymers of styrene or substituted styrene, such as polystyrene, poly(p-chlorostyrene), and polyvinyl toluene; styrene-based copolymers, such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyester; an epoxy resin; an epoxypolyol resin; polyurethane; polyamide; polyvinyl butyral; polyacrylic resin; rosin; modified rosin; a terpene resin; an aliphatic or alicyclic hydrocarbon resin; an aromatic petroleum resin; chlorinated paraffin; and paraffin wax. The above-listed examples may be used alone or in combination.

The master batch can be obtained by applying high shear force to a resin for a master batch and a colorant to mix and kneading the mixture. In order to enhance interaction between the colorant and the resin, an organic solvent may be used. Moreover, a so-called flashing method is preferably used, since a wet cake of the colorant can be directly used without being dried. The flashing method is a method where an aqueous paste containing a colorant is mixed or kneaded with a resin and an organic solvent, and then the colorant is transferred to the resin to remove the moisture and the organic solvent. A high-shearing disperser (e.g., a three-roll mill) is preferably used for the mixing and kneading.

—Charge Controlling Agent—

The charge controlling agent is not particularly limited and may be appropriately selected depending on the intended purpose. Examples of the charge controlling agent include a nigrosine-based dye, a triphenylmethane-based dye, a chrome-containing metal complex dye, a molybdic acid chelate pigment, a rhodamine-based dye, an alkoxy-based amine, a quaternary ammonium salt (including fluorine-modified quaternary ammonium), alkylamide, phosphorus or a compound thereof, is tungsten or a compound thereof, a fluorosurfactant, a metal salt of salicylic acid, and a metal salt of a salicylic acid derivative.

Examples of commercial products of the charge controlling agent include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); and LRA-901, and boron complex LR-147 (manufactured by Japan Carlit Co., Ltd.).

An amount of the charge controlling agent is not particularly limited and may be appropriately selected depending on the intended purpose. The amount of the charge controlling agent is preferably from 0.1 parts by mass through 10 parts by mass, and more preferably 0.2 parts by mass through 5 parts by mass relative to 100 parts by mass of the toner. When the amount of the charge controlling agent is greater than 10 parts by mass, the toner is excessively charged to lower an effect of a main charge controlling agent, and therefore electrostatic attraction force to a developing roller increases to cause low flowability of the developer, or low image density.

The charge controlling agent may be melt-kneaded with a master batch or resin, followed by dissolving or dispersing therein, or may be directly added to an organic solvent when the master batch or resin is dissolved or dispersed therein. Alternatively, the charge controlling agent may be fixed on surfaces of toner particles after producing the toner particles.

—Flowability Improving Agent—

The flowability improving agent is not particularly limited as long as the flowability improving agent is an agent used to perform a surface treatment to increase hydrophobicity to prevent degradation of flowability and charging properties even in high humidity environment. The flowability improving agent may be appropriately selected depending on the intended purpose. Examples thereof include a silane coupling agent, a silylating agent, a fluoroalkyl group-containing silane coupling agent, an organic titanate-based coupling agent, an aluminium-based coupling agent, silicone oil, and modified silicone oil. The silica and the titanium oxide are particularly preferably subjected to a surface treatment with any of the above-listed flowability improving agents to be used as hydrophobic silica and hydrophobic titanium oxide.

—Cleaning Improving Agent—

The cleaning improving agent is not particularly limited as long as the cleaning improving agent is an agent added to the toner for removing the residual developer on a photoconductor or a primary is transfer medium after transferring. The cleaning improving agent may be appropriately selected depending on the intended purpose. Examples thereof include: fatty acid (e.g., stearic acid) metal salts, such as zinc stearate, and calcium stearate; and polymer particles produced by soap-free emulsion polymerization, such as polymethyl methacrylate particles, and polystyrene particles. The polymer particles are preferably polymer particles having a relatively narrow particle size distribution, and are suitably polymer particles having the volume average particle diameter of from 0.01 μm through 1 μm.

—Magnetic Material—

The magnetic material is not particularly limited and may be appropriately selected depending on the intended purpose. Examples of the magnetic material include iron powder, magnetite, and ferrite. Among the above-listed examples, white magnetic materials are preferable in view of color tone.

<<External Additives>>

—Silicon Oxide—

The silicon oxide includes silica particles having a particle size of 50 nm or greater but less than 200 nm. When the particle size of the silica is less than 50 nm, the silica does not sufficiently function as a spacer, sufficient durability cannot be obtained, and the silica tends to be embedded into toner base particles, which may cause deterioration in is quality overtime. When the particle size of the silica is 200 nm or greater, flowability or chargeability may be impaired.

—Other Particles—

The above-mentioned other particles that may be included in the external additives are not particularly limited as long as the particles are particles other than the above-mentioned alumina particles or the above-mentioned silica particles. The above-mentioned other particles may be appropriately selected depending on the intended purpose. The above-mentioned other particles are preferably hydrophobicity-treated inorganic particles.

Examples of the shapes of the above-mentioned other particles include spheres, needle shapes, and non-spherical shapes obtained by joining several spherical particles.

The above-mentioned other particles are not particularly limited and may be appropriately selected depending on the intended purpose. Examples thereof include silica particles, hydrophobic silica, fatty acid metal salt (e.g., zinc stearate, and aluminium stearate), metal oxide (e.g., titania, alumina, tin oxide, and antimony oxide), and a fluoropolymer.

The hydrophobicity-treated oxide particles, hydrophobicity-treated silica particles, hydrophobicity-treated titania particles, and hydrophobicity-treated alumina particles can be obtained, for example, by treating hydrophilic particles with a silane coupling agent, such as is methyltrimethoxysilane, methyltriethoxysilane, and octyltrimethoxysilane. Moreover, silicone oil-treated oxide particles or inorganic particles obtained by processing inorganic particles with silicone oil optionally with heating are also suitably used.

Examples of the silicone oil include dimethylsilicone oil, methylphenylsilicone oil, chlorophenylsilicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, methacryl-modified silicone oil, and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride.

An amount of the above-mentioned other particles is not particularly limited and may be appropriately selected depending on the intended purpose. The amount thereof is preferably from 0.1% by mass through 5% by mass, and more preferably from 0.3% by mass through 3% by mass.

<Production Method of Toner>

The production method of the toner is not particularly limited and may be appropriately selected depending on the intended purpose. The production method preferably includes a mixing step. The mixing step includes mixing the color particles and the external additives.

The color particles are preferably formed by dispersing, in an aqueous medium, an oil phase including the amorphous polyester resin A, the amorphous polyester resin B, and the crystalline polyester resin C, and optionally further including the release agent, and the colorant.

Moreover, the color particles are preferably formed by dispersing, in an aqueous medium, an oil phase including the non-linear reactive precursor, the amorphous polyester resin B, and the crystalline polyester resin C, and optionally further including the curing agent, the release agent, and the colorant.

Examples of the above-described production method of the color particles include a dissolution suspension method known in the art.

As an example of the production method of the color particles, a method for forming toner base particles with elongating an amorphous polyester resin A through an elongation reaction and/or cross-linking is reaction between the prepolymer and the curing agent will be described hereinafter. The above-described production method includes preparation of aqueous medium, preparation of an oil phase including toner material, emulsification or dispersion of the toner materials, and removal of an organic solvent. Thereafter, the obtained color particles are mixed with the external additives to obtain the toner.

<<Preparation of Aqueous Medium (Aqueous Phase)>>

The preparation of an aqueous medium can be performed by dispersing organic particles in an aqueous medium. An amount of the organic particles in the aqueous medium is not particularly limited and may be appropriately selected depending on the intended purpose. The amount of the organic particles is preferably from 0.5 parts by mass through 10 parts by mass relative to 100 parts by mass of the aqueous medium.

The aqueous medium is not particularly limited and may be appropriately selected depending on the intended purpose. Examples of the aqueous medium include water, a solvent miscible with water, and a mixture of water and the solvent miscible with water. The above-listed examples may be used alone or in combination. Among the above-listed examples, water is preferable.

The solvent miscible with water is not particularly limited and is may be appropriately selected depending on the intended purpose. Examples of the solvent miscible with water include alcohol, dimethylformamide, tetrahydrofuran, cellosolves, and lower ketones. The alcohol is not particularly limited and may be appropriately selected depending on the intended purpose. Examples of the alcohol include methanol, isopropanol, and ethylene glycol. The lower ketones are not particularly limited and may be appropriately selected depending on the intended purpose. Examples of the lower ketones include acetone, and methyl ethyl ketone.

<<Preparation of Oil Phase>>

The preparation of an oil phase including toner materials can be performed by dissolving or dispersing, in an organic solvent, toner materials including at least the non-linear reactive precursor, the amorphous polyester resin B, and the crystalline polyester resin C, optionally further including the curing agent, the release agent, and the colorant.

The organic solvent is not particularly limited and may be appropriately selected depending on the intended purpose. The organic solvent is preferably an organic solvent having a boiling point of lower than 150° C. because such an organic solvent can be easily removed.

The organic solvent having a boiling point of lower than 150° C. is is not particularly limited and may be appropriately selected depending on the intended purpose. Examples of the organic solvent having a boiling point of lower than 150° C. include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methyl isobutyl ketone. The above-listed examples may be used alone or in combination.

Among the above-listed examples, ethyl acetate, toluene, xylene, benzene, methylene chloride, 1,2-dichloroethane, chloroform, and carbon tetrachloride are preferable, and ethyl acetate is more preferable.

<<Emulsification or Dispersion>>

The emulsification or dispersion of the toner materials can be performed by dispersing the oil phase including the toner materials in the aqueous medium. When the toner materials are emulsified or dispersed, the curing agent and the non-linear reactive precursor are allowed to react through an elongation reaction and/or cross-linking reaction to generate the amorphous polyester resin A.

For example, the amorphous polyester resin A can be generated by any of the following methods (1) to (3).

(1) A method where an oil phase including the non-linear reactive precursor and the curing agent is emulsified or dispersing in an aqueous is medium, and the curing and the non-linear reactive precursor are allowed to react through an elongation reaction and/or cross-linking reaction in the aqueous medium to generate the amorphous polyester resin A.

(2) A method where an oil phase including the non-linear reactive precursor is emulsified or dispersed in an aqueous medium to which the curing agent has been added in advance, and the curing and the non-linear reactive precursor are allowed to react through an elongation reaction and/or cross-linking reaction in the aqueous medium to generate the amorphous polyester resin A.

(3) A method where an oil phase including the non-linear reactive precursor is emulsified or dispersed in an aqueous medium, followed by adding the curing agent to the aqueous medium so that the curing agent and the non-linear reactive precursor are allowed to react through an elongation reaction and/or cross-linking reaction from interfaces of particles in the aqueous medium, to thereby generate amorphous polyester resin A.

When the curing agent and the non-linear reactive precursor are allowed to react through an elongation reaction and/or cross-linking reaction from interfaces of particles, the amorphous polyester resin A is formed predominantly at surfaces of generated toner particles to impart the toner particles with a concentration gradient of the amorphous polyester resin A.

Reaction conditions (e.g., a reaction time and a reaction temperature) for generating the amorphous polyester resin A are not particularly limited, and may be appropriately selected depending on a combination of the curing agent and the non-linear reactive precursor.

The reaction time is not particularly limited and may be appropriately selected depending on the intended purpose. The reaction time is preferably from 10 minutes through 40 hours, and more preferably from 2 hours through 24 hours.

The reaction temperature is not particularly limited and may be appropriately selected depending on the intended purpose. The reaction temperature is preferably from 0° C. through 150° C., and more preferably from 40° C. through 98° C.

A method for stably forming dispersion liquid including the non-linear reactive precursor in the aqueous medium is not particularly limited and may be appropriately selected depending on the intended purpose. Examples of the method include a method where an oil phase prepared by dissolving or dispersing toner materials in a solvent is added to an aqueous medium phase, and the mixture is dispersed with shearing force.

A disperser used for the dispersing is not particularly limited and may be appropriately selected depending on the intended purpose. Examples of the disperser include a low-speed shearing disperser, a high-speed shearing disperser, a friction disperser, a high-pressure jet disperser, and an ultrasonic disperser.

Among the above-listed examples, a high-speed shearing disperser is preferable because particle diameters of the dispersed elements (oil droplets) can be adjusted to from 2 μm through 20 μm.

When the high-speed shearing disperser is used, conditions, such as rotational speed, a dispersion time, and a dispersion temperature, are appropriately selected depending on the intended purpose.

The rotational speed is not particularly limited and may be appropriately selected depending on the intended purpose. The rotational speed is preferably from 1,000 rpm through 30,000 rpm, and more preferably from 5,000 rpm through 20,000 rpm.

The dispersion time is not particularly limited and may be appropriately selected depending on the intended purpose. In case of a batch system, the dispersion time is preferably from 0.1 minutes through a minutes.

The dispersion temperature is not particularly limited and may be appropriately selected depending on the intended purpose. The dispersion temperature is preferably from 0° C. through 150° C., and more preferably from 40° C. through 98° C. under pressure. Generally speaking, dispersion can be performed easier when the dispersion temperature is a high temperature.

An amount of the aqueous medium used for emulsifying or dispersing the toner materials is not particularly limited and may be appropriately selected depending on the intended purpose. The amount of the aqueous medium is preferably from 50 parts by mass through 2,000 parts by mass, and more preferably from 100 parts by mass through 1,000 parts by mass relative to 100 parts by mass of the toner materials.

When the amount of the aqueous medium is less than 50 parts by mass, the dispersed state of the toner materials is poor and therefore color particles having the predetermined particle size may not be obtained. When the amount of the aqueous medium is greater than 2,000 parts by mass, the production cost increases.

When the oil phase including the toner materials are emulsified or dispersed, a disperser is preferably used for stabilizing dispersed elements, such as oil droplets, to obtain desired particle shapes, and make the particle size distribution sharp.

The dispersant is not particularly limited and may be appropriately selected depending on the intended purpose. Examples of the dispersant include a surfactant, a poorly water-soluble inorganic compound dispersant, and a polymer-based protective colloid.

The above-listed examples may be used alone or in combination. Among the above-listed examples, a surfactant is preferable.

The surfactant is not particularly limited and may be appropriately selected depending on the intended purpose. For example, an anionic surfactant, a cationic surfactant, a nonionic surfactant, or an amphoteric surfactant may be used. The anionic surfactant is not particularly limited and may be appropriately selected depending on the intended purpose. Examples of the anionic surfactant include alkyl benzene sulfonic acid salt, α-olefin sulfonic acid salt, and phosphoric acid ester. Among the above-listed examples, a surfactant including a fluoroalkyl group is preferable.

A catalyst may be used for an elongation reaction and/or cross-linking reaction for generating the amorphous polyester resin A.

The catalyst is not particularly limited and may be appropriately selected depending on the intended purpose. Examples of the catalyst include dibutyl tin laurate, and dioctyl tin laurate.

<<Removal of Organic Solvent>>

A method for removing the organic solvent from the dispersion liquid, such as the emulsified slurry, is not particularly limited and may be appropriately selected depending on the intended purpose. Examples of the method include a method where an entire reaction system is gradually heated to evaporate the organic solvent in the oil droplets, and a method where the dispersion liquid is sprayed in a dry atmosphere to remove the organic solvent in the oil droplets.

As the organic solvent is removed, toner base particles are formed. The toner base particles may be subjected to washing and drying, and may be further subjected to classification. The classification may be performed by removing the fine particle component using a cyclone in a liquid, a decanter, or by centrifugation. Alternatively, the classification may be performed after drying.

<<Mixing Step>>

The obtained color particles are mixed with the external additives. A typical powder mixer can be used for mixing with the additives. The mixer preferably includes a jacket to adjust an internal temperature. In order to change a history of load applied to the additives, additives may be added in the middle of mixing, or added gradually. In this case, rotational speed, rolling speed, a time, a temperature, etc. of the mixer may be changed. Moreover, strong load may be applied initially, followed by applying relatively weak load, or vice versa. Examples of the usable mixer include a V-type mixer, a rocking mixer, LODIGE MIXER, NAUTA MIXER, and HENSCHEL MIXER. Subsequently, the resultant is passed through a 250-mesh sieve to remove coarse particles and aggregated particles, to thereby obtain a toner.

<Developer>

The developer used for the present disclosure is preferably a two-component developer including a toner and a carrier. When the toner is used for a two-component developer, the toner is mixed with a carrier powder. In this case, any carrier known in the art may be used as the carrier. Examples of the carrier include iron powder, magnetite powder, nickel powder, glass beads, and any of the above-listed powder or beads surface-coated with a resin. As the particle size of the carrier, the volume average particle diameter of the carrier is preferably from 25 μm through 200 μm.

(Container)

The container used for the present disclosure is a container, in which the toner, or a developer including the toner and a carrier is stored. The container is not particularly limited, and may be appropriately selected from containers known in the art. Suitable examples of the container include a container including a toner container main body in which the toner is stored, and a cap.

A size, shape, structure, material etc. of the container main body is not particularly limited and may be appropriately selected depending on the intended purpose. For example, the shape of the container main body is preferably a cylinder, and is particularly preferably a shape where a spiral groove with a convex-concave shape is formed on the inner circumferential surface of the container main body so that the toner, which the content of the container, can be moved towards the side of the outlet, and the whole or part of the spiral groove has a bellows function.

A material of the container main body is not particularly limited, and is preferably a material having excellent dimensional precision. Examples of the material include resins. Among the resins, for example, a polyester resin, a polyethylene resin, a polypropylene resin, a polystyrene resin, a poly vinyl chloride resin, polyacrylic acid, a polycarbonate resin, an ABS resin, and a polyacetal resin are suitably listed.

Since the container of the present disclosure enables easy storage and transportation, and excels in handling, the container can be detachably mounted in the below-described process cartridge of the present disclosure or the above-described image forming apparatus, etc. and is suitably used for replenishment of the toner or developer.

(Process Cartridge)

The process cartridge according to the present disclosure includes a developing device including the above-described developer, and at least one selected from the group consisting of an image bearer, a charging device, and a cleaning device disposed to be integrated, and the process cartridge is detachably mounted in a main body of the image forming apparatus. In addition to the units mentioned above, the process cartridge may further include any of units known in the art, such as a charge-eliminating device, disposed to be integrated.

EXAMPLES

The present disclosure will be described below by way of Examples. The present disclosure should not be construed as being limited to these Examples. In Examples, "part(s)" denotes "part(s) by mass" and "%" denotes "% by mass" unless otherwise stated.

(Synthesis of Ketimine 1)

A reaction vessel equipped with a stirring rod and a thermometer was charged with 170 parts of isophorone diamine and 75 parts of methyl ethyl ketone. The resultant mixture was allowed to react for 5 hours at 50° C., to thereby obtain [Ketimine 1]. [Ketimine 1] had an amine value of 418 mgKOH/g.

(Synthesis of Amorphous Polyester Prepolymer A)

A reaction vessel equipped with a cooling tube, a stirrer, and a nitrogen-inlet tube was charged with 3-methyl-1,5-pentanediol, adipic acid, and trimellitic anhydride in a manner that a molar ratio of hydroxyl groups to carboxyl group was to be 1.5, and the amount of the trimellitic anhydride to the total amount of the monomers was to be 1 mol %, and 1,000 ppm of titanium tetraisopropoxide was added relative to the total is amount of the monomers. Next, the resultant mixture was heated to 200° C. for about 4 hours, and then heated to 230° C. for further 2 hours to allow the mixture to react until discharge of water was stopped. Thereafter, the resultant was further reacted for 5 hours under the reduced pressure of from 10 mmHg through 15 mmHg, to thereby obtain [Amorphous Polyester A-1] including a hydroxyl group.

A reaction vessel equipped with a cooling tube, a stirrer, and a nitrogen-inlet tube was charged with [Amorphous Polyester A-1]including a hydroxyl group and isophorone diisocyanate in a manner that a molar ratio of isocyanate groups to hydroxyl groups was to be 2.0. Next, the resultant was diluted with ethyl acetate, followed by reacting for 5 hours at 100° C., to thereby obtain [50% Amorphous Polyester Prepolymer A-1 Ethyl Acetate Solution].

A reaction vessel equipped with a heater, a stirrer, and a nitrogen inlet tube was charged with 150% Amorphous Polyester Prepolymer A-1 Ethyl Acetate Solution). After stirring [50% Amorphous Polyester Prepolymer A-1 Ethyl Acetate Solution], [Ketimine 11 was added by dripping in a manner that a molar ratio of amino groups to isocyanate groups was to be 1. Next, the resultant was stirred for 10 hours at 45° C., followed by vacuum drying at 50° C. until the residual amount of the ethyl acetate was to be 100 ppm or less, to thereby obtain (Amorphous Polyester A-1]. [Amorphous Polyester A-1] had a glass is transition temperature of −55° C., and a weight average molecular weight of 130,000.

(Synthesis of Amorphous Polyester B)

A reaction vessel equipped with a nitrogen inlet tube, a dehydration tube, a stirrer, and a thermocouple was charged with a bisphenol A ethylene oxide (2 mol) adduct (BisA-EO), a bisphenol A propylene oxide (3 mol) adduct (BisA-PO), terephthalic acid, and adipic acid in a manner that a molar ratio of BisA-EO to BisA-PO was to be 40/60, a molar ratio of terephthalic acid to adipic acid was to be 93/7, and a molar ratio of hydroxyl groups to carboxyl groups was to be 1.2, and 500 ppm of titanium tetraisopropoxide relative to the total amount of the monomers was added. Next, the resultant mixture was allowed to react for 8 hours at 230° C., followed by reacting for 4 hours under the reduced pressure of from 10 mmHg through 15 mmHg. Thereafter, 1 mol % of trimellitic acid was added relative to the total amount of the monomers, followed by reacting the mixture for 3 hours at 180° C., to thereby obtain [Amorphous Polyester B]. [Amorphous Polyester B] had a glass transition temperature of 67° C. and a weight average molecular weight of 10,000.

(Synthesis of Crystalline Polyester C)

A reaction vessel equipped with a nitrogen inlet tube, a dehydration tube, a stirrer, and a thermocouple was charged with sebacic acid and 1,6-hexanediol in a manner that a molar ratio of hydroxyl groups to carboxyl groups was to be 0.9, and 500 ppm of titanium tetraisopropoxide was added relative to the total amount of the monomers. Next, the resultant mixture was allowed to react for 10 hours at 180° C., followed by heating to 200° C. and reacting the mixture for 3 hours. The resultant was further reacted for 2 hours under the reduced pressure of 8.3 kPa, to thereby obtain [Crystalline Polyester C-1]. [Crystalline Polyester C-1] had a melting point of 67° C. and a weight average molecular weight of 25,000.

<Melting Point and Glass Transition Temperature>

A melting point and a glass transition temperature were measured by means of a differential scanning calorimeter (Q-200, available from TA Instruments Inc.). Specifically, a sample container formed of aluminium was charged with about 5.0 mg of a measurement sample, the sample container was placed on a holder unit, and the holder unit was set in an electric furnace. Next, the sample was heated from −80° C. to 150° C. at the heating rate of 10° C./min in a nitrogen atmosphere. A glass transition temperature of the measurement sample was determined from the obtained DSC curve using an analysis program installed in the differential scanning calorimeter. Moreover, the endothermic peak top temperature was determined as a melting point is from the obtained DSC curve using the analysis program installed in the differential scanning calorimeter.

<Weight Average Molecular Weight>

A weight average molecular weight was measured by means of GPC HLC-8220GPC (available from Tosoh Corporation) and columns TSKgel SuperHZM-H 15 cm triple columns (available from Tosoh Corporation). Specifically, the columns were stabilized in a heat chamber of 40° C. Next, tetrahydrofuran (TH F) was fed to the columns at a flow rate of 1 mL/min, and 50 μL to 200 μL of a 0.05% by mass to 0.6% by mass sample THF solution was injected to measure a weight average molecular weight of the sample. A number average molecular weight of the sample was calculated from a relationship between logarithms and count number of the calibration curve prepared using several monodisperse polystyrene standard samples.

As standard polystyrene samples, samples having weight molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (available from Pressure Chemical or available from Tosoh Corporation) was used. Moreover, a refractive index (RD detector was used as a detector.

Example 1

<Preparation of Master Batch 1>

By means of HENSCHEL MIXER (available from Nippon Cole & is Engineering Co., Ltd.), 1,200 parts of water, 500 parts of carbon black Printex35 (available from Degussa) having DBP oil absorption of 42 mL/100 mg and pH of 9.5, and 500 parts of [Amorphous Polyester B] were mixed, followed by kneading the mixture for 30 minutes at 150° C. using a twin-roller kneader. Subsequently, the resultant was rolled and cooled, followed by pulverizing by means of a pulverizer, to thereby obtain [Master Batch 1].

<Synthesis of Wax Dispersant 1>

An autoclave reaction chamber equipped with a thermometer and a stirrer was charged with 480 parts of xylene, and 100 parts of SANWAX 151P (available from SANYO CHEMICAL, LTD.), which was polyethylene having a melting point of 108° C. and a weight average molecular weight of 1,000, followed by dissolving the polyethylene and purging with nitrogen. While adding a mixed liquid including 805 parts of styrene, 50 parts of acrylonitrile, 45 parts of butyl acrylate, 36 parts of di-t-butylperoxide, and 100 parts of xylene by dripping for 3 hours, the mixture was allowed to polymerized at 170° C., and the temperature was maintained for 30 minutes. Then, the solvent was removed, to thereby obtain (Wax Dispersant 11. (Wax Dispersant 11 had a glass transition temperature of 65° C., and a weight average molecular weight of 18,000.

<Preparation of Wax Dispersion Liquid 1>

A vessel equipped with a stirring rod and a thermometer was is charged with 300 parts of paraffin wax HNP-9 (available from Nippon Seiro Co., Ltd.) having a melting point of 75° C., 150 parts of [Wax Dispersant 1], and 1,800 parts of ethyl acetate. Next, the resultant mixture was heated to 80° C. with stirring, and the temperature was maintained for 5 hours, followed by cooling to 30° C. over 1 hour. The resultant was dispersed by means of a bead mill, ULTRA VISCOMILL (available from AIMEX CO., Ltd.) under the conditions that zirconia beads each having a diameter of 0.5 mm were packed in the amount of 80% by volume, and the number of passes was 3, to thereby obtain (Wax Dispersion Liquid 11. During the dispersing, the feeding rate was set to 1 kg/h and the disc circumferential speed was set to 6 m/s.

<Preparation of Crystalline Polyester Dispersion Liquid 1>

A vessel equipped with a stirring rod and a thermometer was charged with 308 parts of [Crystalline Polyester C-1] and 1,900 parts of ethyl acetate. Next, the resultant mixture was heated to 80° C. with stirring, and the temperature was maintained for 5 hours, followed by cooling to 30° C. over 1 hour. The resultant was dispersed by means of a bead mill, ULTRA VISCOMILL (available from AIMEX CO., Ltd.) under the conditions that zirconia beads each having a diameter of 0.5 mm were packed in the amount of 80% by volume, and the number of passes was 3, to thereby obtain [Crystalline Polyester Dispersion Liquid 1]. During the dispersing, the feeding rate was set to 1 kg/h and the disc circumferential speed was set to 6 m/s.

<Preparation of Oil Phase 1>

A vessel was charged with 225 parts of [Wax Dispersion Liquid 1], 40 parts of [50% Amorphous Polyester Prepolymer A Ethyl Acetate Solution], 390 parts of [Amorphous Polyester B], 225 parts of [Crystalline Polyester Dispersion Liquid 1], 60 parts of [Master Batch 1], and 285 parts of ethyl acetate, followed by mixing the resultant by means of TK Homomixer (available from PRIMIX Corporation) for 60 minutes at 7,000 rpm, to thereby obtain (Oil Phase 11.

<Synthesis of Vinyl-Based Resin Dispersion Liquid>

A reaction vessel equipped with a stirring rod and a thermometer was charged with 683 parts of water, 11 parts of a sodium salt of sulfuric acid ester of methacrylic acid-ethylene oxide adduct, ELEMINOL RS-30 (available from SANYO CHEMICAL, LTD.), 138 parts of styrene, 138 parts of methacrylic acid, and 1 part of ammonium persulfate, and the resultant mixture was stirred for 15 minutes at 400 rpm, to thereby obtain a white emulsion. Next, the internal temperature of the system was heated to 75° C., and the emulsion was allowed to react for 5 hours. To the resultant, 30 parts of a 1% ammonium persulfate aqueous solution was added. The resultant mixture was matured for 5 hours at 75° C., to thereby obtain a vinyl-based resin dispersion liquid. The vinyl-based is resin dispersion liquid had the volume average particle diameter of 0.14 μm.

The volume average particle diameter of the vinyl-based resin dispersion liquid was measured by means of a laser diffraction/scattering particle size distribution analyzer LA-920 (available from HORIBA. Ltd.).

<Preparation of Aqueous Phase 1>

Water (990 parts), 83 parts of the vinyl-based resin dispersing liquid serving as organic particles, 37 parts of a 48.5% sodium dodecyldiphenyl ether disulfate aqueous solution ELEMINOL MON-7 (available from SANYO CHEMICAL, LTD.), and 90 parts of ethyl acetate were mixed and stirred, to thereby obtain milky white [Aqueous Phase 1].

<Emulsification and Removal of Solvent>

To a vessel, in which (Oil Phase 11 was accommodated, 0.2 parts of [Ketimine 1], and 1,200 parts of [Aqueous Phase 1] were added. The resultant mixture was mixed for 20 minutes at 13,000 rpm by TK Homomixer, to thereby obtain [Emulsified Slurry 1]. A vessel equipped with a stirrer and a thermometer was charged with [Emulsified Slurry 1], the solvent was removed for 8 hours at 30° C., and the resultant was matured for 4 hours at 45° C., to thereby obtain [Dispersion Slurry 1].

<Washing, Heating Treatment, and Drying>

[Dispersion Slurry 1] (100 parts) was subjected to vacuum filtration. Next, 100 parts of ion-exchanged water was added to the is filtration cake, and the resultant was mixed for 10 minutes at 12,000 rpm by means of TK Homomixer, followed by performing filtration (referred to as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 4 hours at 50° C., followed by performing filtration. After drying the filtration cake for 48 hours at 45° C. by means of an air-circulating drier, the resultant was is passed through a sieve with a mesh size of 75 μm, to thereby obtain [Color Particles 1].

<External Additives Mixing Step>

Twenty-liter HENSCHEL MIXER (available from Nippon Cole & Engineering Co.. Ltd.) was charged with 100 parts of (Color Particles 11 and 2 parts of silica (AEROSIL NX900, available from NIPPON AEROSIL CO., LTD.). The resultant was mixed for 20 minutes at the circumferential speed of 40 m/s, followed by passing through a 500-mesh sieve, to thereby obtain [Toner 1].

<Production of Carrier>

The following composition was dispersed for 10 minutes by a homomixer, to thereby obtain a silicone resin coating film forming solution. As cores, sintered ferrite powder having the volume average particle diameter of 70 μm was used. The coating film forming solution was applied onto a surface of each core to give a film thickness of 0.15 μm by means of a spin coater (available from OKADA SEIKO CO., LTD.) with the coater internal temperature of 40° C., followed by drying. The coated ferrite powder was fired by leaving the carrier in an electric furnace for 1 hour at 300° C. After cooling, the obtained ferrite powder bulks were crushed using a sieve having a mesh size of 125 μm, to thereby produce a carrier.

Silicone resin solution: 132.2 parts

[SR2410, available from Dow Corning Toray Co., Ltd., solid content: 23%]

Aminosilane: 0.66 parts

[SH6020, available from Dow Corning Toray Co., Ltd., solid content: 100%]

Conductive Particles 1: 31 parts

[Base: alumina, surface treatment: lower layer of tin dioxide/upper layer of indium oxide including tin dioxide, particle diameter: 0.35 μm, particle powder specific resistance: 3.5 Ω·cm]

Toluene: 300 parts

<Preparation of Developer>

[Toner 1] (8% by mass) produced and 92% by mass of the carrier above were mixed to prepare a two-component developer.

<Image Forming Apparatus>

Image formation was performed by the toner image forming unit 1K using the image forming apparatus illustrated in FIG. 1. By means of the image forming apparatus, an image having an imaging area of 5% and an image having an imaging area of 20% were alternately output per 1,000 sheets each with setting the speed difference between the photoconductor and the transfer conveyance belt to 0.2%, at 23° C. and 50% RH when printing 0 sheets or greater but less than 10,000 sheets, at 28° C. and 85% RH when printing 20,000 sheets or greater but less than 30,000 sheets. Three sets of the image formation by the above-described image forming apparatus were performed to output 90,000 sheets.

<Evaluations>

<<Transfer Properties: A Central Image Void Phenomenon>>

The state of a central image void phenomenon in the image formed after completing image formation on 90,000 sheets was confirmed and evaluated based on the following criteria.

[Evaluation Criteria]

AA: No "central image void" phenomenon was confirmed by observation with naked eyes.

A: A "central image void" phenomenon was confirmed with difficulty by observation with naked eyes, and the "central image void" phenomenon did not impair image quality.

B: A "central image void" phenomenon was relatively easily confirmed with observation with naked eyes.

Figure 3:
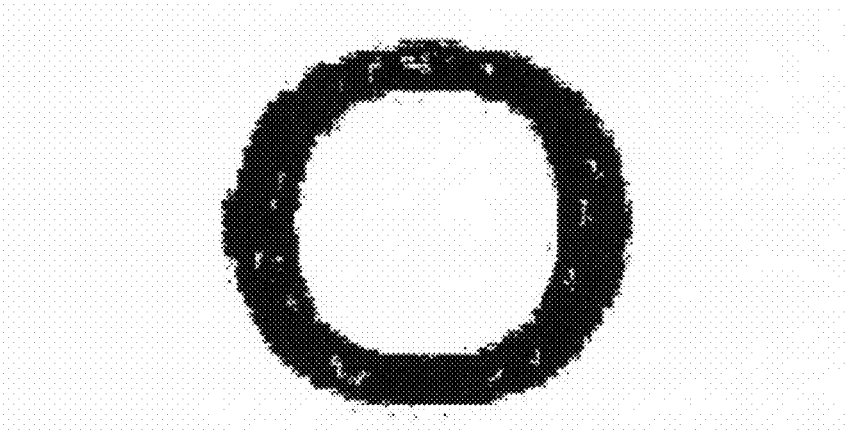
FIG. 3 is a view for explaining a central image void phenomenon.

C: A "central image void" phenomenon was immediately spotted by anyone as a result of observation with naked eyes (see FIG. 3).

<<Photoconductor Cleaning>>

After completing the image formation on 90,000 sheets, a 3-band chart (A4, land scape) having a band pattern each having a width of 43 mm (relative to a sheet traveling direction) was output as an evaluation image on 100 sheets in the laboratory environment of 32° C., 54% RH. The obtained image was observed with naked eyes, and cleaning properties were evaluated based on the presence or absence of an image defect due to a cleaning failure.

[Evaluation Criteria]

AA: The toner passed through due to a cleaning failure was not confirmed on neither the printed sheet nor the photoconductor, and lines formed of the passed through toner could not be confirmed when the surface of the photoconductor was observed along the length direction under a microscope.

A: The toner passed through due to a cleaning failure could not be observed on neither the printed sheet nor the photoconductor by observation with naked eyes.

B: The toner passed through due to a cleaning failure could not be observed on the printed sheet but could be observed on the photoconductor by observation with naked eyes.

C: The toner passed through due to a cleaning failure could be confirmed on both the printed sheet and the photoconductor by observation with naked eyes.

<<Transfer Filming>>

After completing the image formation on 90,000 sheets, observation of the surface of the transfer member, and observation of formation of an image defect in the solid image were performed and evaluated based on the following criteria. The transfer filming means a state where the toner and the external additives are adhered onto the transfer member by pressure applied by the cleaning blade so that developing cannot be performed.

[Evaluation Criteria]

AA: Very good

A: No adhesion on the transfer member

B: The adhesion of the toner or external additives was very slightly observed on the transfer member, but a white void could not be detected in the solid image.

C: The adhesion of the toner or external additives was observed on the transfer member, and a white void was detected in the solid image.

<<Comprehensive Evaluation>>

The evaluation criteria of the comprehensive evaluation was as follows. "AA" was very good, "A" was good, "B" was an acceptable level, and "C" was an unacceptable level on practical use. "AA," "A," and "B" were determined as being acceptable, and "C" was determined as being not acceptable.

[Evaluation Criteria]

AA: There were two or more "AA" without "B" and "C."

A: There was one or less "A" without "B" and "C."

B: There was one or more "B" without "C."

C: There was one or more "C."

Example 2

Evaluations were performed in the same manner as in Example 1, except that the speed difference between the photoconductor and the transfer conveying belt in the image forming apparatus was changed to 0.4%.

Example 3

Evaluations were performed in the same manner as in Example 1, except that the speed difference between the photoconductor and the transfer conveying belt in the image forming apparatus was changed to 0.8%.

Example 4

[Color Particles 2] and [Toner 2] were obtained and evaluations were performed in the same manner as in Example 1, expect that the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to is as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 4 hours at 63° C., followed by performing filtration. After drying the filtration cake for 48 hours at 45° C. by means of an air-circulating drier, the resultant was passed through a sieve with a mesh size of 75 μm, to thereby obtain [Color Particles 2].

Example 5

[Color Particles 3] and [Toner 3] were obtained and evaluations were performed in the same manner as in Example 1, expect that the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 4 hours at 55° C., followed by performing filtration. After drying the filtration cake for 48 hours at 45° C. by means of an air-circulating drier, the resultant was passed through a sieve with a mesh size of 75 μm, to thereby obtain [Color Particles 3].

Example 6

Evaluations were performed in the same manner as in Example 1, except that the speed difference between the photoconductor and the transfer conveyance belt in the image forming apparatus was changed to 0.4%, and the toner for use was changed to [Toner 2].

Example 7

[Color Particles 4] and [Toner 4] were obtained and evaluations were performed in the same manner as in Example 1, expect that the organic particles were changed from the vinyl-based resin dispersion liquid to the following organic particles dispersion liquid.

<Synthesis of Organic Particle Aqueous Dispersion Liquid>

A reaction vessel equipped with a stirrer, a heating and cooling device, and a thermometer was charged with 3,760 parts by weight of water, and 150 parts by weight of polyoxyethylene-1-(allyloxymethyl)alkyl ether ammonium sulfate (HITENOL KH-1025, available from DKS Co., Ltd.), and the resultant mixture was stirred at 200 rpm to homogenize the mixture. The homogenized mixture was heated to increase the internal system temperature to 75° C. Thereafter, 90 parts by weight of a 10% by weight ammonium persulfate aqueous solution was added, followed by adding a mixture including 430 parts by weight of styrene, 270 parts by weight of butyl acrylate, and 300 parts by weight of methacrylic acid by dripping over 4 hours. After the dripping, the resultant was matured for 4 hours at 75° C., to thereby obtain a particle dispersion liquid including a resin (a2-1), which was a polymer obtained by copolymerizing the monomers and the polyoxyethylene-1-(allyloxymethyl) alkyl ether ammonium sulfate. The volume average particle diameter of the particles in the particle dispersion liquid was 30 nm.

<Distance Between Organic Particles>

(1) The external additives were removed as much as possible by a liberation treatment of the external additives using ultrasonic waves to make the toner as close as the state of the toner base particles.

(Liberation Method of External Additives)

[1] A 100 mL screw vial was charged with 50 mL of a 5% by mass is surfactant aqueous solution (product name: NOIGEN ET-165, available from DKS Co., Ltd.). To the solution, 3 g of the toner was added, and the vial was gently agitated in up-down and left-right motions. Thereafter, the resultant was stirred by a ball mill for 30 minutes to homogeneously disperse the toner in the dispersion solution.

[2] Then, ultrasonic energy was applied to the resultant for 60 minutes by means of an ultrasonic homogenizer (product name: homogenizer, type: VCX750, CV33, available from Sonics & Materials, Inc.) with setting the output to 40 W.

Ultrasonic Wave Conditions

Vibration duration: continuous 60 minutes

Amplitude: 40 W

Vibration onset temperature: 23° C.±1.5° C.

Temperature during vibrations: 23° C. ≡1.5° C.

[3](1) The dispersion liquid was subjected to vacuum filtration with filter paper (product name: Quantitative filter paper (No. 2, 110 mm), available from Advantec Toyo Kaisha, Ltd.). The resultant was washed twice with ion-exchanged water, followed by performing filtration. After removing the free additives that had been detached from the toner particles, the toner particles were dried.

(2) The toner obtained in (1) was observed under scanning electron microscope (SEM). First, a backscattered electron image was observed to detect external additives and/or filler including Si.

(3) The image of (1) was binarized using image processing software (ImageJ), to eliminate the external additives and/or filler.

Next, the toner of the same location as (1) was observed to obtain a secondary electron image. The organic particles (OMS) were not observed in the backscattered electron image, but were observed only in the secondary electron image. With reference to the image obtained in (3), therefore, the particles present in the region other than the residual external additives and fillers (other than the region excluded in (3)) were determined as the organic particles, and a distance between the particles (a distance between the center of one particle and the center of another particle present next to the one particle) was measured using the image processing software.

The standard deviation of the distance between the organic particles was calculated according to the following formula (1), where x was a distance between particles.

$$\sqrt{\frac{1}{n-1}\sum_{k=1}^{n}(x_i - \bar{x})} \qquad \text{Formula (1)}$$

[Image Capturing Conditions]

Scanning electron microscope: SU-8230

Image capturing magnification: 35,000 times

Captured image: secondary electron (SE(L)) image, backscattered electron (BSE) image Acceleration voltage: 2.0 kV Acceleration current: 1.0 ρA Probe current: Normal Focus mode: UHR WD: 8.0 mm

Example 8

[Color Particles 5] and [Toner 5] were obtained and evaluations were performed in the same manner as in Example 1, expect that the speed difference between the photoconductor and the transfer conveying belt in the image forming apparatus was changed to 0.4%, the organic particles were changed from the vinyl-based resin dispersion liquid to the organic particle dispersion liquid of Example 7, and the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to is as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 4 hours at 63° C., followed by performing filtration. After drying the filtration cake for 48 hours at 45° C. by means of an air-circulating drier, the resultant was passed through a sieve with a mesh size of 75 μm, to thereby obtain (Color Particles 51.

Example 9

[Color Particles 6] and [Toner 6] were obtained and evaluations were performed in the same manner as in Example 1, expect that the organic particles were changed from the vinyl-based resin dispersion liquid to the organic particle dispersion liquid of Example 7, and the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 4 hours at 55° C., followed by performing filtration. After drying the filtration cake for 48 hours at 45° C. by means of an air-circulating drier, the resultant was passed through a sieve with a mesh size of 75 μm, to thereby obtain [Color Particles 6].

Example 10

Evaluations were performed in the same manner as in Example 8, except that the speed difference between the photoconductor and the transfer conveyance belt in the image forming apparatus was changed to 0.1%, and the toner for use was changed to [Toner 5].

Example 11

[Color Particles 7] and (Toner 71 were obtained and evaluations were performed in the same manner as in Example 1, expect that the speed difference between the photoconductor and the transfer conveying belt in the image forming apparatus was changed to 0.4%, the organic particles were changed from the vinyl-based resin dispersion liquid to the organic particle dispersion liquid of Example 7, and the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration is (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 8 hours at 50° C., followed by performing filtration. After drying the filtration cake for 48 hours at 45° C. by means of an air-circulating drier, the resultant was passed through a sieve with a mesh size of 75 μm, to thereby obtain [Color Particles 7].

Comparative Example 1

Evaluations were performed in the same manner as in Example 1, except that the speed difference between the photoconductor and the transfer conveying belt in the image forming apparatus was changed to 0%.

Comparative Example 2

Evaluations were performed in the same manner as in Example 1, except that the speed difference between the photoconductor and the transfer conveying belt in the image forming apparatus was changed to 0.9%.

Comparative Example 3

[Color Particles 8] and (Toner 81 were obtained and evaluations is were performed in the same manner as in Example 1, expect that the speed difference between the photoconductor and the transfer conveying belt in the image forming apparatus was changed to 0.4%, and the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 4 hours at 48° C., followed by performing filtration. After drying the filtration cake for 48 hours at 45° C. by means of an air-circulating drier, the resultant was passed through a sieve with a mesh size of 75 μm, to thereby obtain [Color Particles 8].

Comparative Example 4

[Color Particles 9] and [Toner 9] were obtained and evaluations were performed in the same manner as in Example 1, expect that the speed difference between the photoconductor and the transfer conveying belt in the image forming apparatus was changed to 0.4%, and the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to is as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 4 hours at 68° C., followed by performing filtration. After drying the filtration cake for 48 hours at 45° C. by means of an air-circulating drier, the resultant was passed through a sieve with a mesh size of 75 μm, to thereby obtain [Color Particles 9].

Comparative Example 5

[Color Particles 10] and [Toner 10] were obtained and evaluations were performed in the same manner as in Example 1, expect that the speed difference between the photoconductor and the transfer conveying belt in the image forming apparatus was changed to 0.4%, and the process of <Washing, heat treatment, and drying> was performed as follows.

<Washing, Heating Treatment, and Drying>

[Dispersion Slurry 1] (100 parts) was subjected to vacuum filtration. Next, 100 parts of ion-exchanged water was added to the filtration cake, and the resultant was mixed for 10 minutes at 12,000 rpm by means of TK Homomixer, followed by performing filtration (referred to as Washing Step (1) hereinafter).

To the filtration cake, moreover, 100 parts of a 10% sodium hydroxide aqueous solution was added, and the resultant was mixed for 30 minutes at 12,000 rpm by means of TK Homomixer, followed by performing vacuum filtration (referred to as Washing Step (2) hereinafter).

Next, 100 parts of 10% hydrochloric acid was added to the filtration cake, and the resultant was mixed for 10 minutes at 12,000 rpm by means of TK Homomixer, followed by performing filtration (referred to as Washing Step (3) hereinafter).

To the filtration cake, moreover, 300 parts of ion-exchanged water was added, and the resultant was mixed for 10 minutes at 12,000 rpm by means of TK Homomixer, followed by performing filtration (referred to as Washing Step (4)).

A series of Washing Steps (1) to (4) were repeated twice. To the resultant filtration cake, 100 parts of ion-exchanged water was added, the resultant was mixed for 10 minutes at 12,000 rpm by means of TK Homomixer, and subjected to a heat treatment for 6 hours at 48° C., followed by performing filtration. After drying the filtration cake for 48 hours at 45° C. by means of an air-circulating drier, the resultant was passed through a sieve with a mesh size of 75 μm, to thereby obtain [Color Particles 7].

The toner evaluation results and image evaluation results are summarized in Tables 1 to 3.

TABLE 1

| Color particles | Ex. 1 Color Particles 1 | Ex. 2 Color Particles 1 | Ex. 3 Color Particles 1 | Ex. 4 Color Particles 2 | Ex. 5 Color Particles 3 | Ex. 6 Color Particles 2 |
|---|---|---|---|---|---|---|
| Organic particles | Vinyl based resin dispersion liquid | | | | | |
| Speed difference | 0.1 | 0.4 | 0.8 | 0.1 | 0.1 | 0.4 |
| Average circularity | 0.971 | 0.971 | 0.971 | 0.979 | 0.086 | 0.979 |
| SF-2 | 119 | 119 | 119 | 114 | 110 | 114 |
| Distance between organic particles on toner base particle surface | Not present | Not present | Not present | Not present | Not present | Not present |
| Transfer properties: central image void phenomenon | B | A | AA | A | AA | AA |
| Photoconductor cleaning | AA | AA | AA | A | B | A |
| Intermediate transfer filming | AA | A | B | A | B | AA |
| Comprehensive evaluation | B | A | B | A | B | AA |

TABLE 2

| | Ex. 7 | Ex. 8 | Ex. 9 | Ex. 10 | Ex 11 |
|---|---|---|---|---|---|
| Color particles | Color Particles 4 | Color Particles 5 | Color Particles 6 | Color Particles 5 | Color Particles 7 |
| Organic particles | Organic particle dispersion liquid | | | | |
| Speed difference | 0.1 | 0.4 | 0.1 | 0.1 | 0.4 |
| Average circularity | 0.971 | 0.979 | 0.986 | 0.979 | 0.971 |
| SF-2 | 119 | 114 | 110 | 114 | 114 |
| Distance between organic particles on toner base particle surface | 300 nm | 300 nm | 300 nM | 300 nm | 300 nm |
| Transfer properties: central image void phenomenon | A | AA | AA | A | AA |
| Photoconductor cleaning | A A | AA | B | AA | AA |
| Intermediate transfer filming | AA | AA | A | AA | A |
| Comprehensive evaluation | AA | AA | B | AA | AA |

TABLE 3

| | Comp. Ex. 1 | Comp. Ex. 2 | Comp. Ex. 3 | Comp. Ex 4 | Comp. Ex. 5 |
|---|---|---|---|---|---|
| Color particles | Color Particles 1 | Color Particles 1 | Color Particles 8 | Color Particles 9 | Color Particles 10 |
| Organtic particles | Vinyl-based resin dispersion liquid | | | | |
| Speed difference | 0 | 0.9 | 0.4 | 0.4 | 0.4 |
| Average circularity | 0.971 | 0.971 | 0.970 | 0.986 | 0.970 |
| SP-2 | 119 | 119 | 120 | 109 | 119 |
| Distance between organic particles on toner base particle surface | Not present | Not present | Not present | Not present | Not present |
| Transfer properties: central image void phenomenon | C | AA | C | B | B |
| Photoconductor cleaning | AA | AA | AA | C | AA |
| Intermediate transfer filming | AA | C | C | B | C |
| Comprehensive evaluation | C | C | C | C | C |

What is claimed is:

1. An image forming apparatus comprising:

an image bearer;

a developing unit configured to develop a latent image formed on the image bearer with a toner to form a toner image; and a transfer member including a contact area that comes in contact with the image bearer, where the toner image is primary transferred from the image bearer to the transfer member, wherein a speed difference between the image bearer and the transfer member at the contact area is 0.1% or greater but 0.8% or less, the toner has an average circularity of 0.971 or greater but 0.986 or less, and a shape factor SF-2 of 110 or greater but 119 or less, and the speed difference is represented by the following formula, $$\text{Speed difference } [\%]=\{(V1-V2)/V2\}\times 100 \qquad \text{[Speed difference]}$$

where V1 is a linear speed of the image bearer, and V2 is a linear speed of the transfer member.

2. The image forming apparatus according to claim 1, wherein the speed difference between the image bearer and the transfer member at the contact area is 0.2% or greater but 0.5% or less.

3. The image forming apparatus according to claim 1, wherein the toner has the average circularity of 0.974 or greater but 0.984 or less.

4. The image forming apparatus according to claim 1, wherein the toner has the shape factor SF-2 of 112 or greater but 117 or less.

5. The image forming apparatus according to claim 1, wherein the toner includes toner base particles, and organic particles embedded in a surface of each of the toner base particles, and a standard deviation is 500 nm or less, where the standard deviation is a standard deviation of a distance between the organic particles disposed next to each other without being in contact, and a standard deviation of a straight line distance connecting between a center of one organic particle and a center of another organic particle.

6. An image forming method comprising:

developing a latent image formed on an image bearer with a toner to form a toner image; and primary transferring the toner image from the image bearer to a transfer member including a contact area that comes in contact with the image bearer, wherein a speed difference between the image bearer and the transfer member at the contact area is 0.1% or greater but 0.8% or less, the toner has an average circularity of 0.971 or greater but 0.986 or less, and a shape factor SF-2 of 110 or greater but 119 or less, and the speed difference is represented by the following formula, $$\text{Speed difference } [\%]=\{(V1-V2)/V2\}\times 100 \qquad \text{[Speed difference]}$$

where V1 is a linear speed of the image bearer, and V2 is a linear speed of the transfer member.

* * * * *